US009670107B2

(12) United States Patent
Eaton et al.

(10) Patent No.: US 9,670,107 B2
(45) Date of Patent: Jun. 6, 2017

(54) MODULAR INSTALLATION FOR THE MANUFACTURE OF AN EXPLOSIVE EMULSION PRECURSOR

(71) Applicant: NITRATES & INNOVATION, Paris (FR)

(72) Inventors: James C. Eaton, Tibshelf (GB); Gilles Jauffret, Lagnes (FR)

(73) Assignee: NITRATES & INNOVATION, Paris (FR)

( * ) Notice: Subject to any disclaimer, the term of this patent is extended or adjusted under 35 U.S.C. 154(b) by 0 days.

(21) Appl. No.: 14/401,347

(22) PCT Filed: Jan. 9, 2014

(86) PCT No.: PCT/FR2014/050032

§ 371 (c)(1),
(2) Date: Nov. 14, 2014

(87) PCT Pub. No.: WO2014/111644

PCT Pub. Date: Jul. 24, 2014

(65) Prior Publication Data

US 2015/0144236 A1 May 28, 2015

(30) Foreign Application Priority Data

Jan. 16, 2013 (FR) ..... 13 50379

(51) Int. Cl.
*C06B 21/00* (2006.01)
*C06B 23/00* (2006.01)
(Continued)

(52) U.S. Cl.
CPC ..... *C06B 47/14* (2013.01); *B01F 1/0011* (2013.01); *B01F 3/0815* (2013.01);
(Continued)

(58) Field of Classification Search
CPC ..... C06B 21/00; C06B 23/00; C06B 47/00; C06B 47/14
See application file for complete search history.

(56) References Cited

U.S. PATENT DOCUMENTS 3,442,727 A * 5/1969 Thornton ..... C06B 47/14 149/45
4,526,633 A 7/1985 Lawrence et al.
(Continued)

FOREIGN PATENT DOCUMENTS

DE 102009052748 A1 5/2011
EP 1207145 A1 5/2002
(Continued)

OTHER PUBLICATIONS

International Search Report mailed Mar. 6, 2014, corresponding to International Patent Application PCT/FR2014/050032.

*Primary Examiner* — Aileen B Felton
(74) *Attorney, Agent, or Firm* — Ladas & Parry LLP

(57) ABSTRACT

The present invention provides a modular installation (1) for carrying out a method of manufacturing an explosive emulsion precursor comprising at least three containers: —a first container (100) for preparing an aqueous phase, including a dissolution first tank (110); and —at least one second and/or third container (200, 300) including a second tank for preparing oily phase (210) and a third tank for preparing emulsion (310); and —at least one fourth and/or fifth container (400, 500) including means (410) for feeding heat and means (510) for feeding electrical energy; and —said first, second and/or third containers (100, 200, 300) being juxtaposed over at least a portion of one of their walls (100*a*, 300*b*, 200*b*) and being provided with openings (170, 370*a*, 275, 375, 270*b*) in their walls.

33 Claims, 12 Drawing Sheets

(51) Int. Cl.

| | |
|---|---|
| ***C06B 47/00*** | (2006.01) |
| ***C06B 47/14*** | (2006.01) |
| ***B01F 3/08*** | (2006.01) |
| ***B01F 15/06*** | (2006.01) |
| ***C06B 31/00*** | (2006.01) |
| ***B01F 7/00*** | (2006.01) |
| ***B01F 7/16*** | (2006.01) |
| ***B01F 7/18*** | (2006.01) |
| ***B01F 1/00*** | (2006.01) |
| ***F28D 1/02*** | (2006.01) |
| ***F28D 7/02*** | (2006.01) |
| ***F28D 7/08*** | (2006.01) |
| *F28F 13/12* | (2006.01) |

(52) U.S. Cl.

CPC ..... *B01F 7/00641* (2013.01); *B01F 7/1665* (2013.01); *B01F 7/18* (2013.01); *B01F 15/06* (2013.01); *B01F 15/066* (2013.01); *C06B 21/0008* (2013.01); *C06B 31/00* (2013.01); *C06B 47/145* (2013.01); *F28D 1/0213* (2013.01); *F28D 7/024* (2013.01); *F28D 7/087* (2013.01); *B01F 2015/062* (2013.01); *F28F 13/125* (2013.01)

(56) References Cited

U.S. PATENT DOCUMENTS

| | | | | |
|---|---|---|---|---|
| 4,911,770 | A * | 3/1990 | Oliver | B01F 3/0807 149/109.6 |
| 5,346,564 | A * | 9/1994 | Vance | C06B 21/00 149/109.6 |
| 6,113,715 | A * | 9/2000 | Halander | C06B 47/145 142/2 |
| 2004/0055678 | A1 | 3/2004 | Hales et al. | |

FOREIGN PATENT DOCUMENTS

| | | | |
|---|---|---|---|
| EP | 2143664 | A2 | 1/2010 |
| GB | 2126910 | A | 4/1984 |
| WO | 9626001 | A1 | 8/1996 |
| WO | 9724298 | A1 | 7/1997 |
| WO | 02057059 | A1 | 7/2002 |
| WO | 2004082817 | A1 | 9/2004 |
| WO | 2009092137 | A1 | 7/2009 |

* cited by examiner

MODULAR INSTALLATION FOR THE MANUFACTURE OF AN EXPLOSIVE EMULSION PRECURSOR

This application is a 371 of PCT/FR2014/050032, filed on Jan. 9, 2014, which claims priority to French Application No. 1350379, filed Jan. 16, 2013.

BACKGROUND OF THE INVENTION

The present invention relates to an installation and to a method for on-site preparation of a precursor of an explosive emulsion constituted by a reverse emulsion (water-in-oil).

In order to limit risks linked to transport, explosive precursors are manufactured on-site by emulsifying a concentrated aqueous phase, in particular supersaturated with nitrates constituting an oxidant, in an oily phase containing a surfactant and constituting a mixture of fuels.

The aqueous phase is typically prepared by dissolving nitrates of ammonium and/or sodium and/or calcium in water, to which there are additives for encouraging gasification and additives for adjusting the pH of the aqueous phase. Because of the high concentration of nitrates (in a proportion by weight of approximately 80%-82% for 18%-20% of water) and in order to facilitate dissolving them, the water is heated to a temperature of at least 65° C. (degrees Celsius).

The oily phase is composed of a mixture of various vegetable or mineral fats and surfactants. More particularly, the oily phase obtained by mixing fresh or recycled mineral oils such as paraffin oils and fuel oil, preferably in a proportion by weight of 50/50 to 80/20 with a quantity of surfactant in a proportion of 10% to 30% of the total of the oily phase.

In order to encourage mixing and reduce the temperature difference between the aqueous phase and the oily phase before mixing them into the emulsion, the oily phase is heated to approximately 40° C.-90° C., preferably 50° C.-70° C.

In order to mix and produce the emulsion, a low viscosity premix is prepared in a tank containing stirrer means. Because of its low viscosity, this premix has insufficient stability and its consistency is not appropriate for its subsequent use in preparing the explosive. For this reason, the viscosity of the premix is increased with the aid of a shear device in order to obtain an emulsion with higher viscosity.

Because of the specific nature of the emulsion constituting the explosive precursor, it is advantageously manufactured on-site in a modular installation that is transportable and that can be set up on-site in containers. In order to facilitate transport, the elements allowing the precursor manufacturing method to be carried out are transported in containers. The arrangement of those elements in the containers is such that as few operations as possible are needed when setting up the installation.

More particularly, the present invention concerns a modular installation for carrying out a method of manufacturing an explosive emulsion precursor constituted by a water-in-oil reverse emulsion, the method comprising:

a) a step of preparing an aqueous phase by dissolving nitrates in water and heating;

b) a step of preparing an oily phase by mixing components comprising at least one vegetable and/or mineral fat and a surfactant, and heating; and c) a step of preparing said emulsion by mixing said aqueous phase into said oily phase. Said emulsion is subsequently rendered explosive by adding and mixing chemical reagents such as a solution of sodium nitrite and/or solid sensitizing agents such as glass microspheres in on-site manufacturing units just before use as an explosive for introducing into blast holes.

U.S. Pat. No. 4,526,633 and GB 2 126 910 disclose small mobile installations, in particular in the form of a truck carrying a platform supporting tanks in particular respectively for storing the aqueous phase and the oily phase, together with means for manufacturing an explosive in situ by mixing said aqueous and oily phases and other components. Firstly, those small installations have small production capacity, and secondly they are relatively dangerous because oxidant (aqueous phase) and fuel (oily phase) are transported close to each other with no safe physical separation of the tanks. Further, the tank containing said aqueous phase needs to be thermally insulated, in particular in order to prevent crystallization of said aqueous phase. Finally, in those methods, an explosive precursor containing only the mixture of aqueous phase and oily phase but without sensitizing agent is not specifically isolated. That results in a method and a device that are relatively complex and expensive to implement.

A modular installation is known from the prior art, essentially composed of two juxtaposed containers that are large (having a length of approximately 12.2 meters (m) (i.e. 40 feet)) and that communicate via one of their longitudinal faces. One of the containers includes dissolution tanks for preparing the aqueous phase and a heater separated by a partition. The other container includes tanks for preparing the oily phase and the reverse emulsion and also a separate electrical unit. Thus, the three steps in preparing the emulsion occur in a common container. The fact that the three steps in preparing the emulsion occur in the same container gives rise to risks as regards the safety of the site and/or of operators in the event of an incident and/or damage.

In addition, transporting containers of such a large size is not easy. It is in fact desirable to be able to transport containers that have already been fitted out, because if the installation is assembled on site, it requires qualified personnel to be mobilized, which gives rise to additional costs, in particular if optional elements are to be added subsequently.

The term "container" as used herein means the steel boxes that are used to transport goods and that have standardized features, in particular in accordance with standards ISO 668 and ISO 1496.

OBJECT AND SUMMARY OF THE INVENTION

The main aim of the present invention is to overcome the above-mentioned disadvantages of the prior art.

More particularly, the aim of the present invention is to feed an improved modular installation, which can be used to optimize the conditions concerning:

- the bulk and the footprint of the installation in its final installed location with a view to maximizing its production yield; and
- transport of the installation; and
- safety, both during transport and during operation by the personnel charged with operating the installation, including optimizing traveling and working conditions for personnel in the installation.

Still more particularly, the installation must be:

- readily transportable without special constraints; and
- capable of being assembled readily on-site without the need for too many hours of work on specific skills; and completely autonomous as regards energy and other necessary sources of raw materials and/or capable of being easily connected to facilities at the operating site; and capable of producing at least 25 (metric) tonnes/day of emulsion, i.e. approximately 6000 tonnes/year; and upgradable, with the possibility of adding features later;

capable of being dismantled for further transport and installation at another site, possibly several times over.

More precisely, the invention provides a modular installation as defined above comprising the following containers, arranged as follows:

a first container for preparing the aqueous phase, said first container including a dissolution first tank provided with first heater means and first stirrer means for heating and stirring the aqueous phase contained in the first container, and said first container containing first circulation means for circulating, by pumping, at least said aqueous phase and water for feeding said first container from a first external tank; and a second container containing a second tank containing second heater means and second stirrer means for preparing the oily phase, and a third container containing a said third tank containing third stirrer means for preparing the emulsion; and at least one of said second and/or third containers containing second circulation means for circulating, by pumping, said oily phase from the second tank to the third tank and for circulating the components of the oily phase from external tanks for storing said components to said second tank, and third circulation means for circulating, by pumping, to evacuate said emulsion from said third tank to an emulsion storage tank; and at least one fourth and/or fifth container including heat transfer fluid feed means for feeding heat transfer fluid to said heater means and electrical energy supply means for supplying electrical energy to at least said circulation means for circulating fluid by pumping and to said stirrer means, preferably a fourth container containing heat transfer fluid feed means and a fifth container containing electrical energy supply means;

said first, second, and/or third containers being juxtaposed at least over a portion of one of their side walls, such that at least a portion of a side wall of said first container is juxtaposed with at least a portion of a side wall of said third container, and at least a portion of a side wall of the second container is juxtaposed with at least a portion of another side wall of the third container, such that said third container is interposed between said first container and said second container; and said first, second, and/or third containers include, in their walls, openings via which there pass and/or are connected lines for transferring fluid between said containers and/or electrical cables;

said openings being capable of being closed off, in particular of being closed off during transport of the containers.

Thus, it should be understood that said first containers and second containers are not juxtaposed one with the other and are thus physically separated by the third container, which makes it possible for the oxidant (aqueous phase) and the fuel (oily phase) to be physically separated, and any inappropriate and dangerous accidental mixing to be prevented.

Because the first container is exclusively and entirely devoted to preparing said aqueous phase, it is possible to use a first container that is small, in particular a container with a standard size of approximately 6.1 m (20 feet) in length. Similarly, because a plurality of juxtaposed containers is deployed, each being devoted to a limited number of steps and/or a limited amount of equipment, then overall, the installation complies with the aims of the invention more easily than prior art installations.

Further, the fact that the principal containers for preparing the aqueous phase or for preparing the oily phase and for mixing the emulsion are juxtaposed over at least one of their side walls means that bulk and footprint can be optimized, and in particular means that operation of the installation is facilitated and the operating risks for the personnel involved are minimized.

Finally, the fact that the containers are provided with openings equipped with elements for rapid connection/disconnection of the fluid transfer lines, including the raw material fluid for the aqueous phase or the oily phase or the emulsion, but also any heat transfer fluid for the heater means, and also the electrical cables, means that assembly and/or dismantling of the installation are facilitated, and transport of the installation is facilitated.

The modular installation of the invention thus presents the advantage of being easy to transport since, once it has been dismantled, the installation is in the form of standard containers that are relatively small in size.

Further, the installation is thus easier to dismantle and erect by a qualified operator. Since the installation has already been erected and tested at the site where the installation was manufactured, during erection of the installation, the operator needs only to re-establish on-site the connections between the various containers.

Moreover, the modular nature of the installation makes it especially easy to add a container containing optional equipment, such as a cooling tower and a plate heat exchanger; the optional equipment could be connected to the installation on-site via openings already made in the various containers.

Finally and above all, the installation can limit risks to the safety of personnel in the event of fire or damage, because the aqueous phase (constituting the oxidant) and the oily phase (constituting the fuel) are physically separate, and also because the oxidant/fuel mixture and the heater are separate.

More particularly, said fluid transfer lines are:

a line for transferring said aqueous phase between the first tank and the third tank;

a line for transferring heat transfer fluid between said heat transfer fluid feed means and said heater means for said first tank; and a line for transferring oily phase between said second tank and said third tank;

a line for transferring heat transfer fluid between said heat transfer fluid feed means and said heater means for said second tank; and a line for evacuating said emulsion between said third tank and a tank for storing the emulsion; and lines for feeding said second tank with oil and surfactants from external storage tanks.

Similarly, said pumping groups more particularly comprise:

a pump for feeding said first tank with water from a said external cistern;

a pump for circulating aqueous phase from said first tank to said third tank;

pumps for feeding oil and surfactant from external storage tanks to said second tank; and a pump for circulating said oily phase from said second tank to said third tank; and a pump for evacuating said emulsion from said third tank to a tank for storing the emulsion inside and/or outside the third container.

Still more particularly, said fluid transfer lines are preferably constituted by portions of lines equipped with connection elements that can be connected and disconnected again from said openings.

Still more particularly, said electrical cables are constituted by portions of cable equipped with connection elements that can be connected and disconnected from complementary plugs in said container walls and/or said openings.

More particularly, said fourth container contains means for feeding hot fluid, comprising a heater for producing steam, said heater means being heat exchangers in which said steam circulates.

Advantageously, said openings in the walls of juxtaposed containers further include means for making connections between the containers.

In a particular embodiment, the installation comprises said first, second and third containers, which are rectangular blocks (a shape referred to below as 'rectangular' for simplicity) and have standard dimensions, in particular in accordance with standards ISO 668 and ISO 1496, which are preferably smaller than the fourth container, preferably by approximately 6.1 m (20 feet) in length, juxtaposed as follows:

at least a front portion of a longitudinal side wall of the first container close to a front transverse side wall equipped with door(s) of the first container is juxtaposed with at least a portion of a side wall, preferably a front transverse side wall, of said third container, said front portion of the longitudinal side wall of the first container being provided with a small first opening leading to the portion of the first container including first circulation means for circulating by pumping, said first small opening being juxtaposed and facing a second small opening in said side wall of the third container, said first and second small openings allowing the passage and/or connection of lines for transferring aqueous phase from said first tank to said third tank; and a first longitudinal side wall of the second container provided with a first large opening being juxtaposed with a first longitudinal side wall of the third container being provided with a second large opening facing said first large opening, said first and second large openings allowing the passage of personnel and the passage of said fluid transfer lines between said second and third containers, a front transverse side wall of the second container provided with a door aligned with said front transverse wall of the third container; and a second longitudinal side wall of the second container including at least one third small opening allowing the passage and/or connection of transfer lines for components of the oily phase from external storage tanks for storing the components of the oily phase to said second tank, and allowing passage and/or connection of the heat transfer fluid transfer line from said heat transfer fluid feed means to said second heater means of said second tank; and a second longitudinal side wall of the third container being provided with at least one opening allowing the passage and/or connection of lines for evacuating said emulsion from said third tank to a tank for storing the emulsion.

This juxtaposition of containers and the passage for an operator is made possible by the presence of a large opening, allowing for better management of the space in the containers and improved ergonomics, and the length of the hydraulic lines transporting aqueous and oily phases to the emulsion preparation tank is optimized.

More particularly, said installation comprises:

said first container includes a portion of line for transferring fluid from said first tank to said third tank, as well as a portion of line for transferring heat transfer fluid between said heat transfer fluid feed means and said first heater means inside said first tank, and a portion of line for feeding water to said first tank; and said second container contains a portion of line for transferring oily phase between said second tank and said third tank, as well as a portion of line for transferring heat transfer fluid between said heat transfer fluid feed means and said second heater means inside said second tank, and portions of lines for feeding oil and surfactants respectively to said second tank; and said third container contains a portion of line for transferring aqueous phase from said first tank to said third tank and a portion of line for transferring oily phase from said second tank to said third tank, and a portion of line for evacuating said emulsion from said third tank to an external storage tank and/or a buffer tank for storing said emulsion.

In accordance with a further aspect of the present invention, the first container includes a first rectangular tank with at least five walls arranged parallel to the respective at least five walls of said first container, said first heater means for said first tank comprising a first tube heat exchanger, said first tube heat exchanger being constituted by a network of continuous heat transfer fluid transfer lines arranged longitudinally and transversely at different heights, which are capable of heating the liquid contained in said first rectangular tank by distributing the heat from the heat transfer fluid circulating in said network of lines throughout the volume of said first tank, preferably with a larger number of lines in the lower portion of the first tank, and said first container further containing said first circulation means for circulating fluid by pumping located between a sixth transverse side wall of said first tank and a front transverse side wall of said first container.

This feature means that the heat can be distributed in an appropriate manner.

Using a rectangular tank means that the volume of the first container can be optimized as regards the quantity of aqueous phase that can be produced in the first container. The proportions by weight used to prepare the reverse emulsion are approximately 90% of aqueous phase to approximately 10% of oily phase, and so the production capacity of the modular installation is directly dependent on the quantity of aqueous phase produced. Using a rectangular tank thus means that the use of the space in the first container can be optimized.

The fact that the first container also includes pumping means supported by a fixed chassis inside said container and located between the first tank for preparing the aqueous phase and one of the walls of the container has the advantage of facilitating access by the operator to the pumping means, while limiting operator access to the dangers represented by the nature of the operations being carried out in the aqueous phase preparation tank.

In accordance with another aspect of the invention, said first heat exchanger of the first rectangular tank comprises a network of cylindrical longitudinal lines arranged continuously at different heights, the longitudinal lines arranged substantially at the same height being connected together at their ends on the same side by line elements forming horizontal transverse connectors, and one end of at least one longitudinal line arranged at a given height being connected to the end of a longitudinal line arranged at a lower or higher height via at least one vertical bend line element, the lines of the upper levels being arranged at small downwardly inclined angles, preferably at an angle of less than 10° relative to the horizontal in the direction for circulating the heat transfer fluid from a top feed orifice at the height of a top transverse connector to a lower evacuation orifice at the height of a first bottom transverse connector.

This particular construction of the tube heat exchanger is adapted to the rectangular shape of the nitrate dissolution tank and means that the distribution of heat in the tank can be optimized.

More particularly, the first heat exchanger in the first tank comprises:

a bottom stage of said longitudinal lines covering the floor of said first rectangular tank, said lines of the bottom stage being regularly spaced in the transverse direction of the first tank and extending substantially horizontally in the longitudinal direction from at least one second bottom transverse connector to said first bottom transverse connector; and at least one higher stage of said longitudinal lines, in a smaller number than the lines of the bottom stage, the lines of the higher stage being positioned either side of a central space with a dimension in the transverse direction of the tank that is larger than the space between two said adjacent lines positioned on the same side of said central space, said central space containing a portion of said first means for stirring the aqueous phase, preferably partially positioned at a height that is between said higher stage and said bottom stage, more preferably another portion of said first stirrer means being positioned above said higher stage.

The greater number of lines of the bottom stage of the heat exchanger is intended to heat the water initially introduced into the tank in an optimized manner to an initial temperature of more than 65%-70° C., as it is at this stage that the maximum heat is required. The higher stage can be used to heat the remainder of the first tank when the volume of the aqueous phase (18%-20%) contained in the first tank, in particular approximately 4 (metric) tonnes (t), increases during dissolution of the nitrate granules (80%-82%), in particular by approximately 20 t, in order to form approximately 24 t of aqueous phase. The presence of stirrers between these two heating elements means that the heat in the first tank can be distributed better, and homogeneous dissolution of the granules of nitrate in the tank is encouraged.

Advantageously, the parallel lines belonging substantially to the same stage of the heat exchanger are inclined towards the bottom of the tank in order to favor the flow of steam. The network of continuous cylindrical lines, some of which are oriented towards the bottom of the rectangular tank, allow for better circulation of the steam and collection of condensates at the tank outlet.

Advantageously, the roof of the first container and the ceiling of said first tank are provided with first openings facing each other and surrounded by first vertical extension walls, which are preferably removable, extending from the ceiling of the first tank to above the roof of the first container and said first extension walls supporting or being capable of supporting elements for routing nitrate into the first tank through said first openings, the nitrate preferably being routed into the first tank with the aid of an unloading screw, the nitrate being distributed inside the first tank in the direction of the first stirrer means with the aid of at least one deflector arranged below the first opening in the ceiling of the first tank, said first openings in the ceiling of the first tank and in the roof of the first container preferably being closable, being capable of being closed off during transport of said first container and said first tank.

Thus, the space used by the first rectangular tank in the first container is maximized; the elements interacting with the first tank are not enclosed in the first container and can pass out of it. In addition, they can be dismantled more easily.

Dismantling the means for routing nitrates during transport is facilitated by the presence of an extension that can be detached and that faces an opening in the roof of the container.

Advantageously, the roof of the first container and the ceiling of the first tank include second openings facing each other and surrounded by second vertical extension walls that are preferably removable, said second extension walls extending from the ceiling of the first tank to above the roof of the first container, said second extension walls supporting first stirrer means comprising at least one vertical rod extending inside the first tank on which rotary stirring blades are mounted that can be driven in rotation about a vertical axis with the aid of a motor, said motor preferably being fixed in a non-permanent manner on the roof of the first container, said second openings preferably being capable of being closed and thus being capable of being closed off during transport.

Dismantling the motor of the stirrer during transport is facilitated by the presence of an extension that can be detached facing an opening in the roof of the container.

In a particular embodiment, the second container for preparing the oily phase includes a single second tank supported by scales and including, inside the second tank, second heater means comprising a second heat exchanger with a helical shape.

Using a weighing tank advantageously means that the quantity of oily phase remaining in the second tank after preparing the emulsion can be precisely determined in order to calculate the quantity of oily phase to be produced for the next production cycle. The second tank with scales also means that the quantity of oily phase produced during each fresh production cycle can be controlled. This solution is particularly original and advantageous having regard to the prior art, in which two mutually communicating tanks are equipped with graduations at the top of a first tank, a second tank containing the remainder; the use of graduations is less precise, as is explained below.

Further, the use of a single second tank has advantages in terms of cost reduction compared with the conventional use of two cylindrical tanks.

In a particular embodiment, the third container for preparing the emulsion includes a said third tank for mixing, a shear device for stabilizing the emulsion and increasing the viscosity of the emulsion evacuated from said third tank in a controlled manner in the direction of a buffer fourth tank intended to temporarily hold the emulsion prepared in said third tank for analysis and/or to facilitate sampling before evacuation and preferably to an external tank for storing the emulsion outside the third container, and the second container and/or the third container include furniture and equipment for laboratory analysis, a control panel for the various said circulation means for circulating by pumping, heater means, and stirrer means.

Since the oily phase is pre-heated to 50° C.-60° C. before being introduced into the emulsion preparation tank, it is not necessary to heat the third tank during preparation of the emulsion. The emulsion obtained has a low viscosity of 6000 centipoises (cps) to 8000 cps at the production temperature. The viscosity of the emulsion obtained is increased in a controlled manner by passing the emulsion through a shear device. Thus, the emulsion gains sufficient stability and a consistency that is appropriate for the subsequent preparation of the explosive.

The buffer tank is intended to temporarily hold the emulsion before its subsequent storage in a storage silo or cistern. The buffer tank can be used to remove the emulsion to carry out quality control without having to stop continuous emulsion production.

The laboratory and a control panel and a switch cabinet means that the operator has all the elements necessary for monitoring preparing the emulsion in the second and third containers.

The present invention also provides a method of preparing an explosive precursor constituted by a said emulsion by using a modular installation in accordance with any preceding claim, comprising:

a) a step of preparing a said aqueous phase by dissolving nitrates in water and heating in said first tank;

b) a step of preparing a said oily phase and heating in said second tank; and c) a step of preparing the emulsion by mixing the aqueous phase into the oily phase inside said third tank, without heating.

More particularly, the following is carried out:

- a step of continuously filling the third tank with said aqueous phase and said oily phase; and
- a step of stabilizing the emulsion and increasing the viscosity of the emulsion evacuated from said third tank in a controlled manner with the aid of a shear device.

The method of the invention can be used to produce emulsion continuously and to increase the yield of emulsion produced. However, the emulsion obtained is of low viscosity, and so the emulsion does not have sufficient stability and has a consistency that is inappropriate for its subsequent use in preparing the explosive. As a consequence, the viscosity of the emulsion obtained is increased in a controlled manner by means of a shear means up to a set value for the viscosity of 10,000 cps to 35,000 cps.

In addition, the quantity of emulsion present in the tank for preparing the emulsion is a minimum, and so the safety of the installation is improved.

Advantageously, the step of mixing the aqueous phase in the oily phase comprises two sub-steps:

- a first sub-step in which an initial quantity of emulsion is prepared by mixing the aqueous phase and the oily phase initially introduced consecutively into the third emulsion preparation tank; and
- a second sub-step in which the emulsion is prepared by mixing the aqueous phase and the oily phase introduced continuously into said third tank and wherein the ratio between the pumping flow rates of said aqueous phase and said oily phase, controlled by flow meters, corresponds to the desired proportions for the aqueous phase and the oily phase, preferably in proportions by weight of 85-95% of aqueous phase for 5-15% of oily phase;
- the two said sub-steps following each other, such that said third tank is never empty, the flow rate for evacuation of the emulsion from said third tank by tapping being constant.

More particularly, in accordance with a further feature of the method of the invention:

- in step c), said third tank is continuously fed with aqueous phase from the first tank and with oily phase from the second tank until the first tank is empty; and
- in step b), said oily phase is prepared in a single second tank equipped with scales, the oily phase being maintained in excess in the second tank, and said scales being used firstly to weigh the residue of the oily phase inside the second tank when the first tank is empty, and secondly to measure the final volume of the second tank after filling the second tank.

BRIEF DESCRIPTION OF THE DRAWINGS

The particular characteristics and advantages of the present invention become apparent from the following detailed description made with reference to the figures in which.

DETAILED DESCRIPTION OF AN EMBODIMENT OF THE INVENTION

Figure 1A:
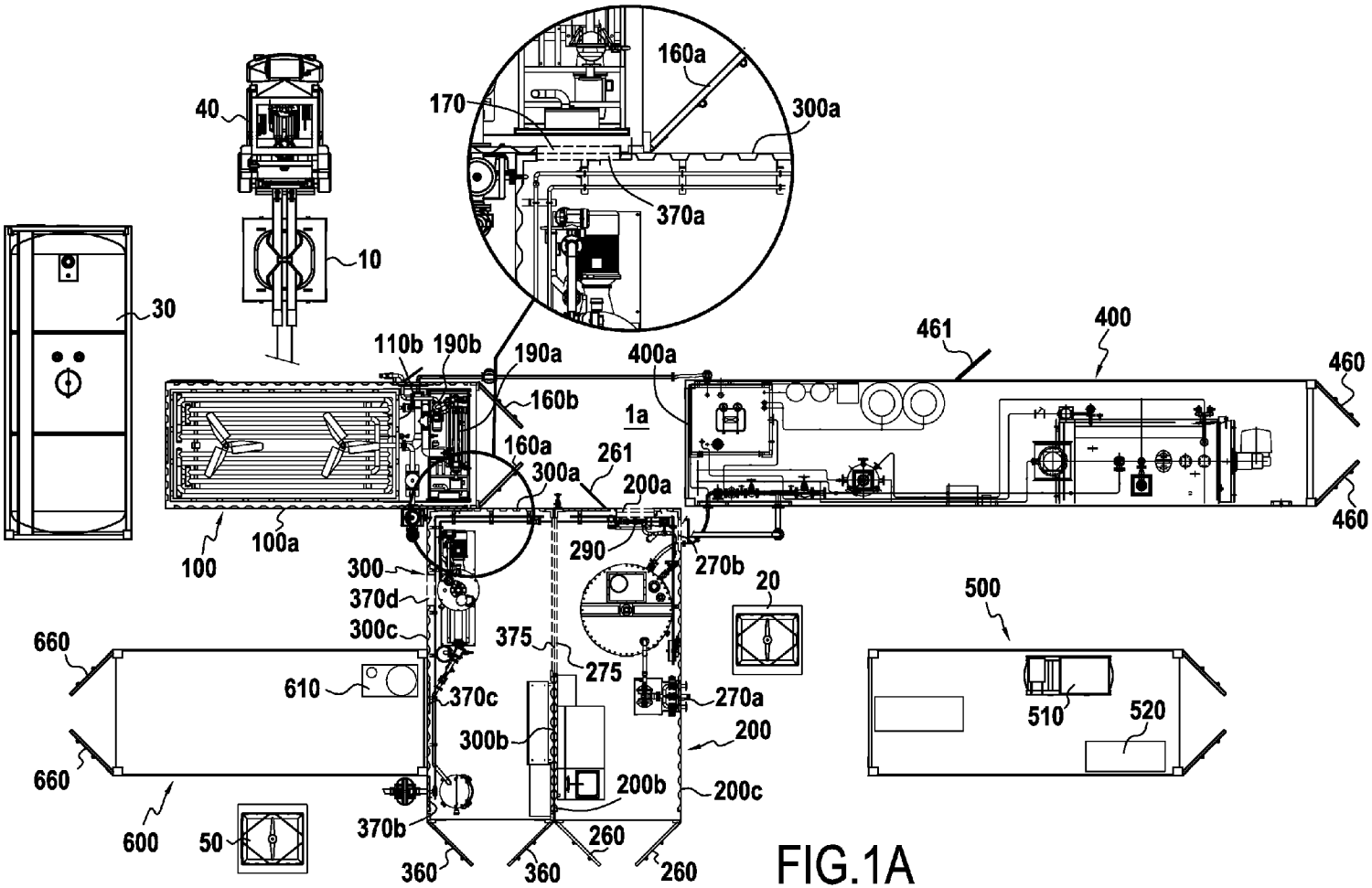
FIGS. 1A and 1B are a top view and horizontal sectional view below the ceiling of the containers of a modular installation of the invention.

The modular installation 1 comprises a first container 100 for preparing an aqueous phase, a second container 200 for preparing an oily phase, and a third container 300 for preparing a reverse emulsion by mixing the aqueous phase and oily phase. Each of the first, second, and third containers 100, 200, and 300 is equipped with first, second, and third tanks 110, 210, 310 for preparing the aqueous phase for the first tank 110, the oily phase for the second tank 210, and the emulsion by mixing the aqueous phase and oily phase incorporating a surfactant for the third tank 310. These three containers also contain pumping means 190*a*, 190*b*, 280, 290, 305, and 336 for routing the fluids concerned via fluid transfer lines into or towards the various tanks, as is described below.

Figure 1B:
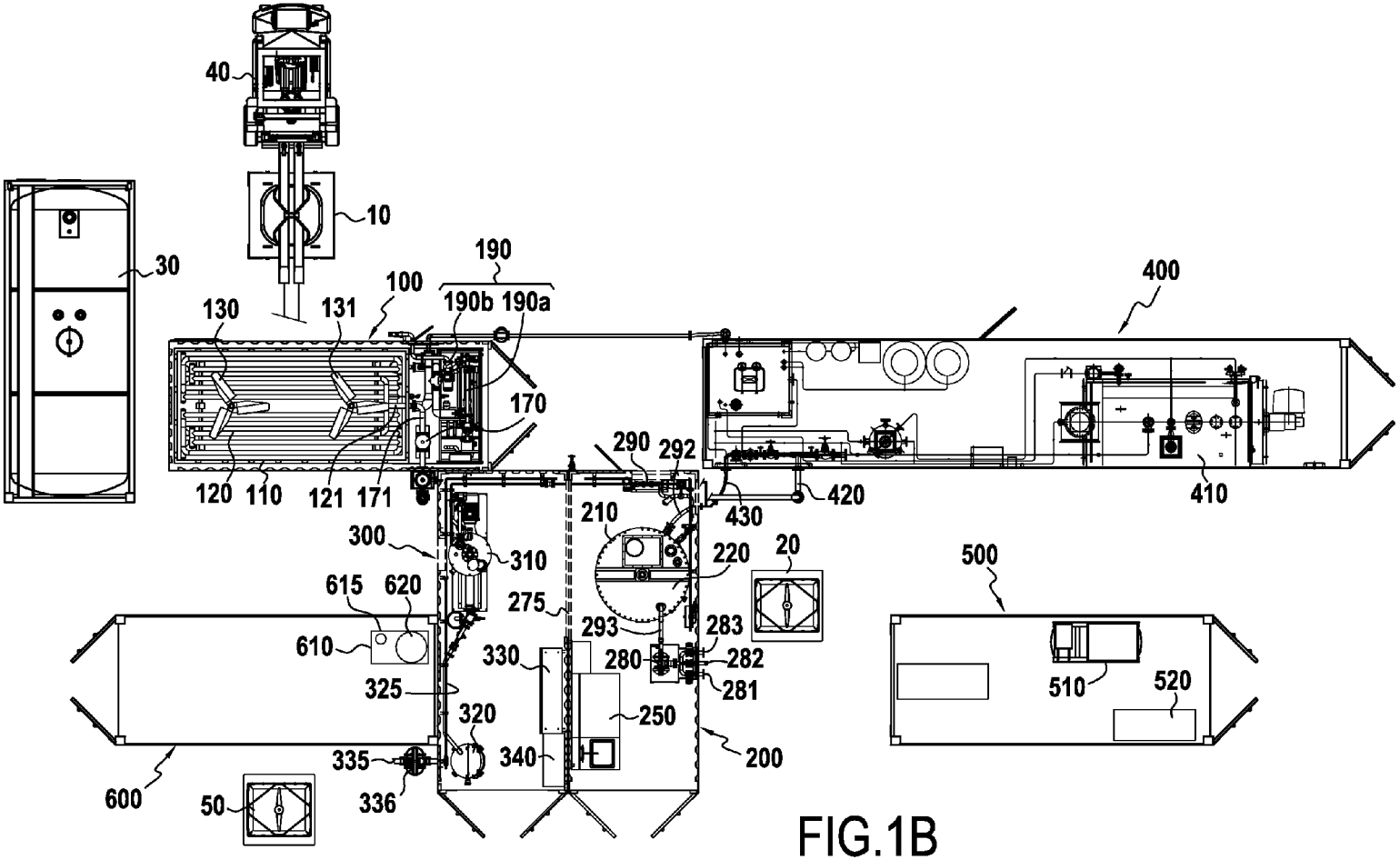
Figure 2A:
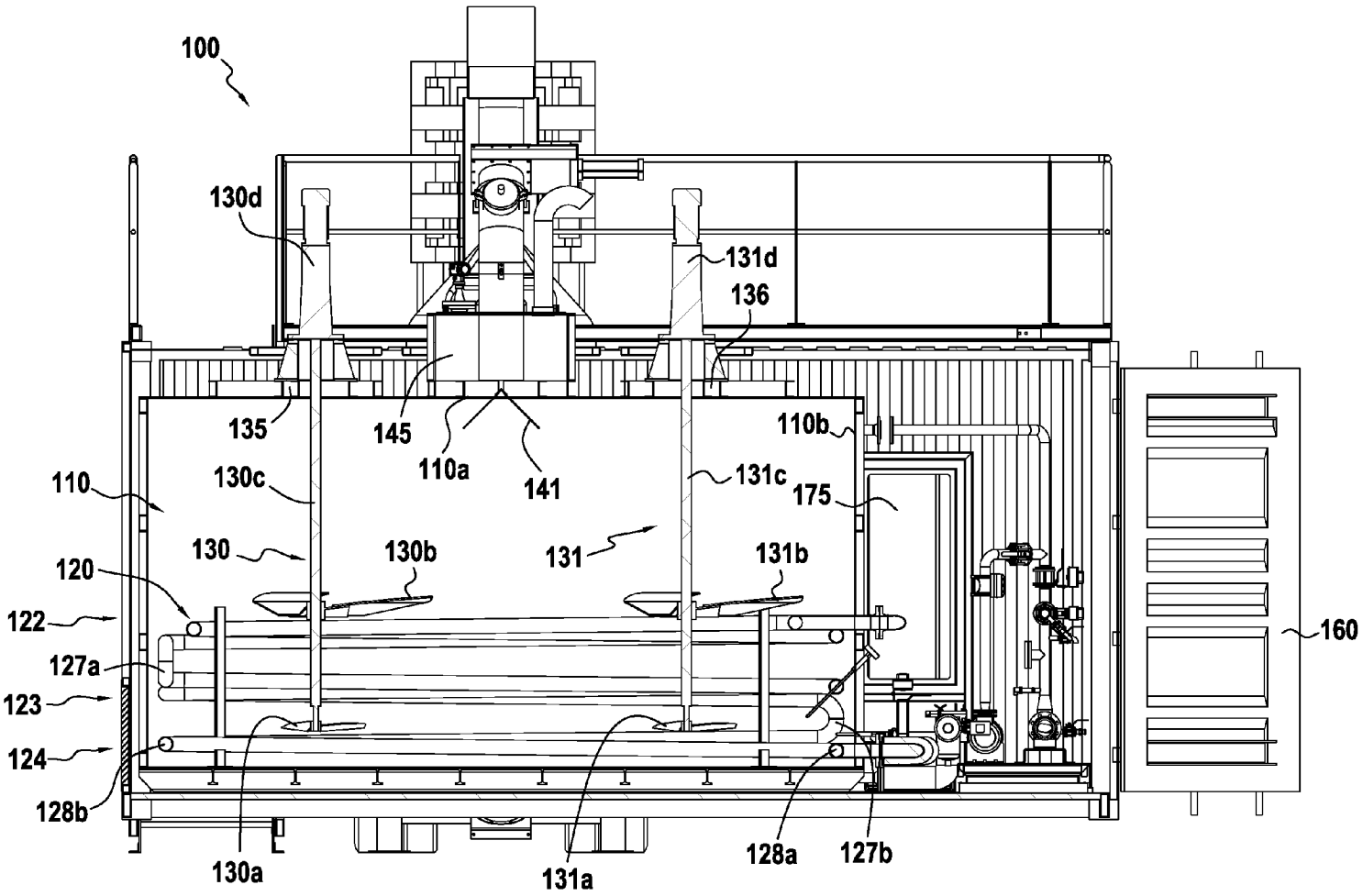
FIG. 2A is a front view in longitudinal section of the first container 100 at the level of the tank 10 for preparing the aqueous phase (of the first tank)
Figure 2B:
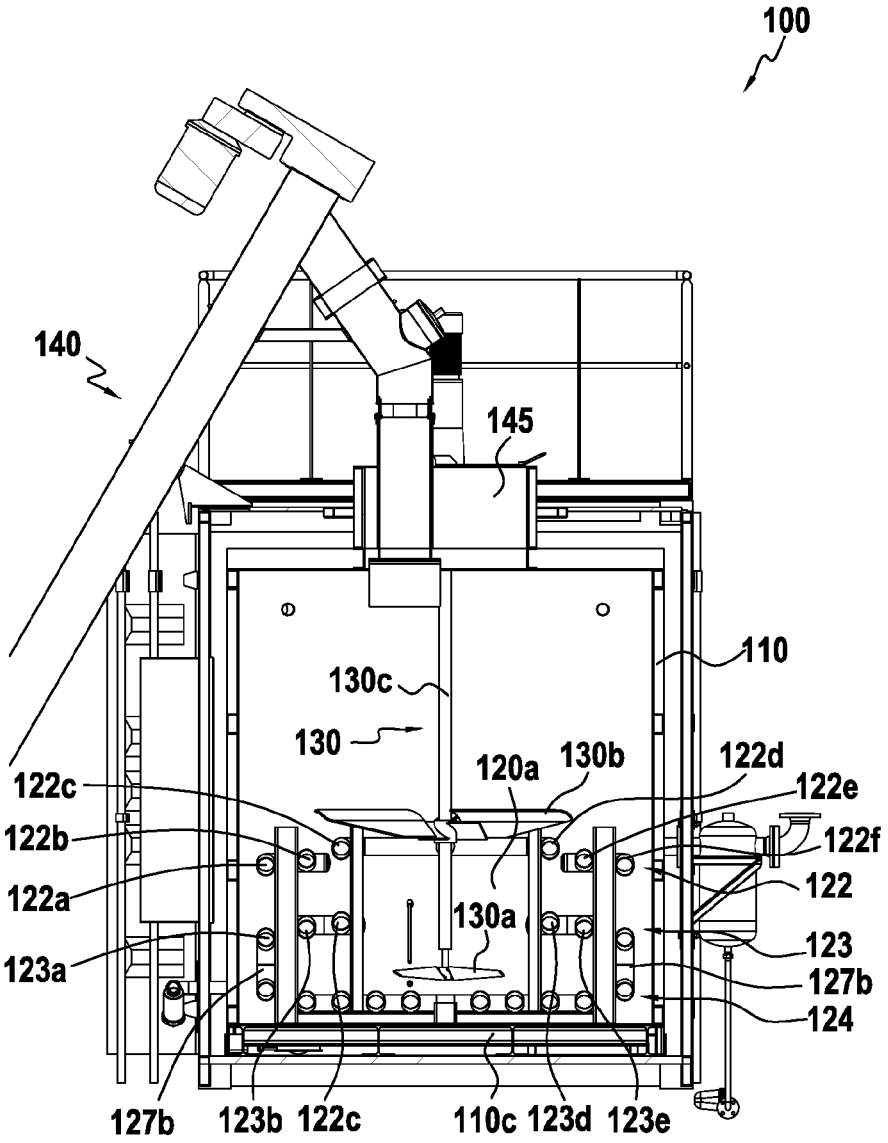
FIG. 2B is a cross sectional view of the first container 100 at the level of the extension walls 145 of the first tank 110.
Figure 2C:
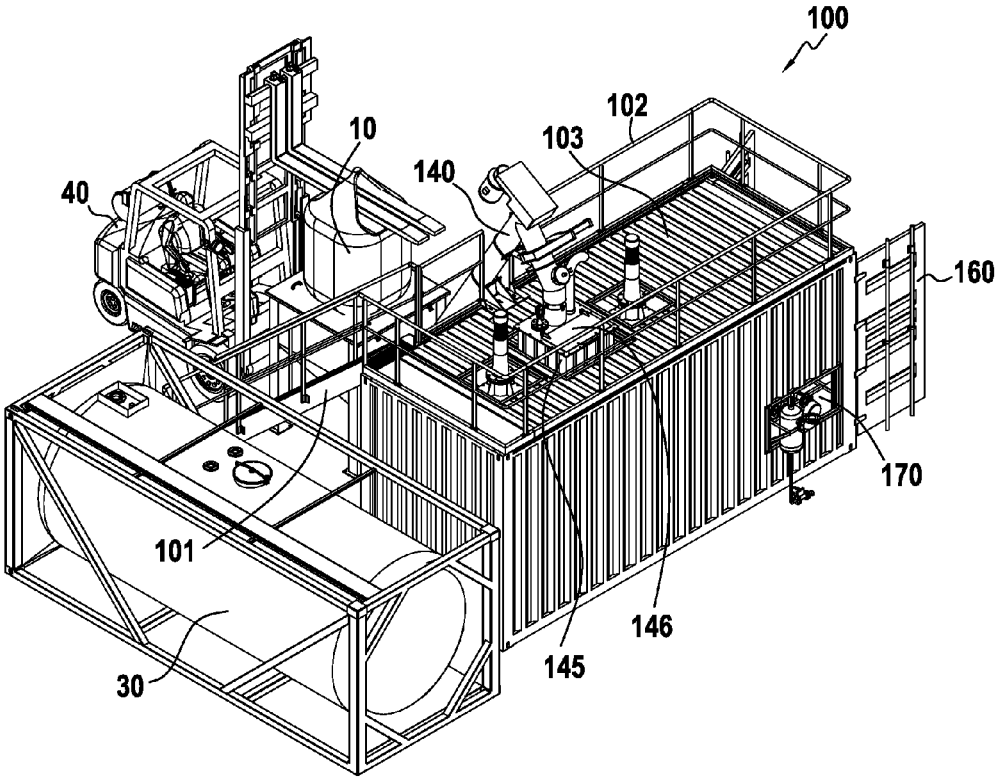
FIG. 2C is a view of the first container 100 with a forklift truck 40 at a nitrate storage tank 10, the first container 100 being arranged close to a water cistern 30.
Figure 2D:
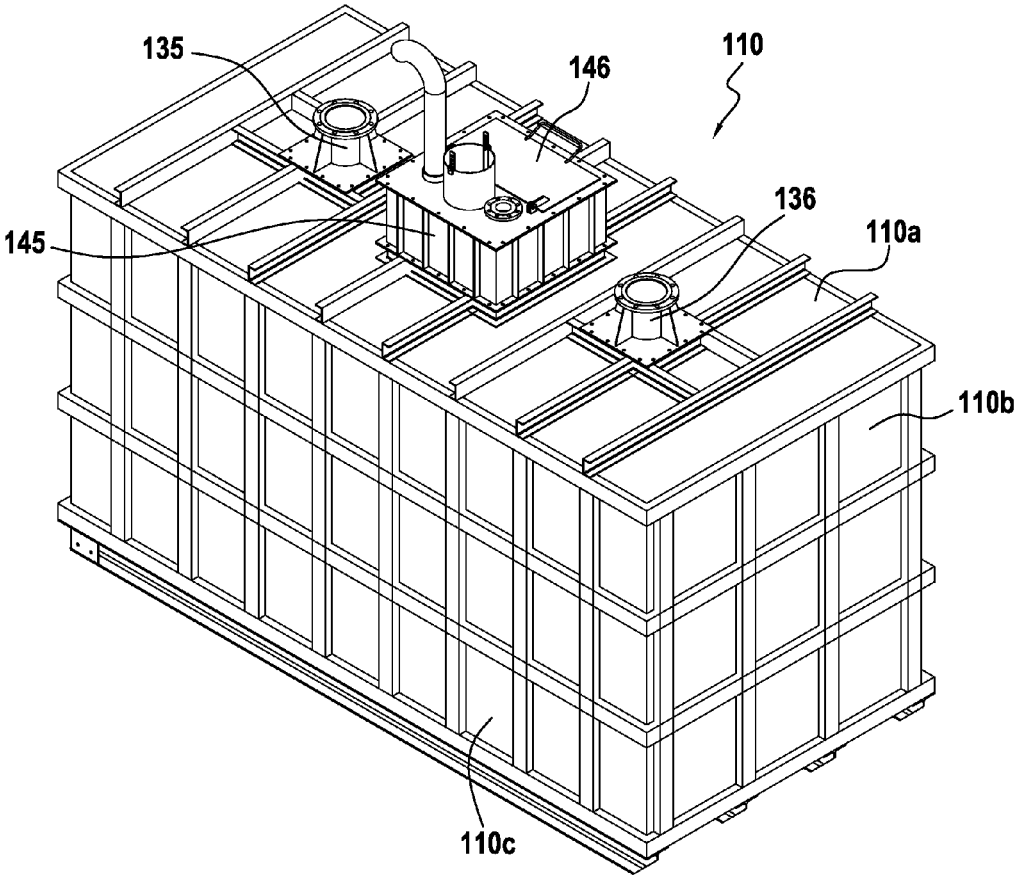
FIG. 2D is a view of said first tank equipped with said extension walls 135, 136, and 145.

FIG. 1 also shows a fourth container 400 including means for feeding heat transfer fluid, more particularly a heater 410 producing steam, and a fifth container 500 including means for producing electricity, namely a generator 510 and also an optional sixth container 600 including means for cooling the emulsion produced with the aid of a cooling tower 610 that is described below.

In the present description, the term "transverse direction" means a horizontal direction perpendicular to the longitudinal horizontal direction of the container concerned or of the first tank. In addition, the term "front wall" or "front portion" means a wall or a portion that is closest to the rectangular access walkway 1*a* described below.

The various containers of the installation 1 are arranged as follows around a rectangular access area 1*a:*

- the front portion of the first container 100 is equipped with a door 160 shown in FIG. 1A. A front portion of the longitudinal wall 100*a* of the first container 100 including an opening 170 straddles a portion of the front transverse wall 300*a* of the third container 300 such that an opening 370*a* in the front transverse wall 300*a* of the third container 300 is arranged facing the opening 170 of the first container 100;
- the second container 200 is arranged parallel to the third container 300 with a first longitudinal wall 200*b* including a large closable opening 275 juxtaposed with and facing a corresponding large closable opening 375 in the first longitudinal wall 300*b* of the third container 300 such that the front transverse wall 200*a* of the second container 200 equipped with a door 261 opening to the walkway 1*a* is aligned with the front transverse wall 300*a* of the third container 300; and
- the fourth container 400 containing a heater 410 is arranged in the same direction as the first container 100, i.e. with its longitudinal walls perpendicular to the longitudinal walls of the second and third containers, one of its transverse walls 400*a* facing the transverse wall of the first container 100 equipped with doors 160 and thus defining the access walkway 1*a*.

In the presently-described embodiment, the second container 200 includes a laboratory equipped with furniture and equipment 250 for monitoring the quality of the fluids obtained from the various emulsion-preparation stages. The third container 300 includes a control panel 330, a fourth buffer tank 320, and an electrical cabinet 340. The buffer tank 320 is intended to hold the emulsion from the third tank temporarily before subsequent storage thereof in a silo or in an external storage cistern 50 with the aid of an evacuation line 335 passing through an opening 370*b* in the second longitudinal wall 300*c* of the third container 300, said line cooperating with a transfer pump 336.

Because the facing large openings 275 and 375 of the juxtaposed second and third containers 200 and 300 have a dimension in the longitudinal direction of the containers of approximately half the length of the container, personnel can operate inside the second and third containers, in particular with a view to monitoring the second tank and also with a view to analyzing production from the third tank, since they can pass easily from one container to the other in the assembled-together second and third containers 200 and 300 that, when the large openings 275 and 375 are open, form a single common large container. These large openings 275 and 375 can thus be used to provide better management of the space in the second and third containers and better ergonomics. Thus, it is possible to use the first, second, and third small standard containers (having a length of approximately 6.1 m (20 feet)), with only the fourth container including the heater 410 being a container of the large standard format (having a length of approximately 12.2 m (40 feet)). In addition, all of the equipment from the heater 410 can be installed in two juxtaposed small containers that communicate via a passage provided in the facing side walls (i.e. 275 and 375).

Additional doors 360 and 260 in the rear transverse side walls of the second and third containers and a door 261 in the front transverse wall of the second container, together with the communication between the second and third containers 200 and 300 via the openings 275 and 375 mean that evacuation can be rapid in the event of an incident, either towards the access walkway 1*a* or towards the rear of the second and third containers.

Because of the above-described layout of the first, second and third containers, the installation of the invention can be used to separate the aqueous phase and oily phase in two different containers on opposite sides of the container for preparing the emulsion, which constitutes the major safety feature of the modular installation of the invention.

Interposing the third container with the third mixing tank 310 between the first container 100 and the second container 200 as described above also means that the lengths of the fluid transfer fluid line between the various tanks can be optimized, and in particular that the length of the transfer lines routing the aqueous phase and the oily phase to the third tank 310 can be relatively shorter.

Although the first container 100 for preparing the aqueous phase and the second and third containers 200 and 300 for preparing the oily phase and the emulsion are physically separated, passage of an operator from one to the other is facilitated by the presence of a door 261 in the front transverse wall 200*a* of the second container 200 and doors 160 in the front transverse wall of the first container 100. The doors 160 allow access to a pumping group 190.

The first dissolution tank 110 is only accessible for maintenance operations via the roof when the tank 110 is empty. This means that personnel safety is improved. Safe access to the roof of the first container 100 is possible by means of a stairway 101 and barriers 102 on the roof 103. Extension walls 145 defining an opening at the ceiling 110*a* of the first tank open above the roof 103 of the first container and are closed off with a plate 146 that provides access when the plate 146 inside the first tank 110 is removed, as is described below.

In addition to the generator 510, a fifth container 500 further includes a compressor 520 that firstly feeds a pneumatic pump 280 with air to transfer oil and surfactant, and secondly feeds a pneumatic pump 336 for transferring emulsion. The pumps 190*a*, 190*b*, 290 and 305 are electric pumps.

The fact that the fourth container and fifth container are spaced from said first, second, and third containers is an additional safety feature.

The installation also includes a cistern 30 containing a feed of water acting to feed the installation with water, in particular the first tank 110 and the heater 410. Advantageously, the cistern 30 is mounted on frame with standard container dimensions in order to facilitate its transport to the installation-site.

Advantageously, the external tanks containing raw materials, such as the nitrates in a large flexible recipient 10 and components of the oily phase such as oil, fuel, and surfactant in the external tanks 20, are readily transportable by means of a forklift truck 40 and are of a size suitable for being able to be stowed in standard containers or the containers of the installation.

The installation optionally includes a sixth container 600 including an optional module 610 for cooling the emulsion. As an example, the cooling module comprises a cooling tower 615 associated with a plate heat exchanger 620. In the particular embodiment described here, this module is not deployed in the installation, but could easily be deployed by connecting the cooling module to the third container 300 for preparing the emulsion via a hydraulic line (not shown) passing through an opening facing a corresponding opening 370*c* formed in the rear longitudinal wall 300*c* of the third container 300.

Advantageously, the modular installation 1 of the invention is constituted by first, second, third, fifth, and sixth containers with a standard length of approximately 6.1 m in length (20 feet), only the fourth container 400 containing the heater 410 being a container that is approximately 12.2 m in length (40 feet) because of the large quantity of steam to be fed to the installation. Because of the dimensions of the first tank, the first container 100 including the first dissolution tank 110 may be constituted by a container that is approximately 6.1 m in length (20 feet) and that is 30 centimeters (cm) taller than standard containers that are approximately 6.1 m in length, and is known as a "high cube".

More precisely, the dimensions of the containers 200, 300, 500 and 600 are as follows: length "L" 6.058 m, width "l" 2.438 and height "H"=2.591. These containers are produced in a standard manner from sheet steel.

The openings of said containers are closable and can be closed off and secured during transport of the containers with the aid of detachable closures. In this manner, the container takes up a configuration that is adapted to being transported with other standard containers. Possible damage to the containers due to the presence of off-center elements or openings weakening the structure of the container is thus avoided.

The openings may be intended to facilitate the passage of people for maintenance operations in particular, or for the passage of electrical cables and hydraulic lines allowing communication between the various containers.

The openings 170 and 370*a* in the first and third containers 100 and 300 allow a portion of line to pass for transferring aqueous phase from the first container 100, which line portion is connected to a line portion 313 that is itself connected to the third tank 310 for preparing the emulsion and cooperating with a flow meter 311*b* for monitoring the flow rate of the aqueous phase inside the third container 300.

The portion of line 291 for transferring oily phase from the second tank 210 of the second container 200 to the third tank 310 for preparing the emulsion passes through the large openings 275 and 375 in the adjacent longitudinal walls of the second and third containers, with the aid of a pump 290 inside the second container for connecting with a line portion 312 connected to the third tank and cooperating with a flow meter 311*a* for monitoring the flow rate of the oily phase.

A steam transfer line 430 extends from the heater 410, passing through an opening 270*b* of the second longitudinal wall 200*c* of the second container to feed a line 292 inside the second container connected to the upper end 222 of a helical tube heat exchanger 220 inside the second tank 210.

A transfer line 293 can route the components of the oily phase (oil, fuel, and surfactants) from the tank 20 passing through an opening 270*a* in the second longitudinal side wall 200*c* of the second container towards said second tank 210 with the aid of a pump 280 inside the second container from connection valves 281, 282 and 283 to which the feed lines for each of the components are connected. A transfer line 325 can transfer emulsion, with the aid of a pump 305, from the third tank 310 to a buffer tank 320 or to an evacuation line 335 cooperating with a valve 336, or it can be evacuated to an external storage tank 40 by passing through an opening 370*b* in the longitudinal second side wall 300*c* of the third container 300.

A steam transfer line 420 extends from the heater 410, passes through the second and third containers through the openings 270*b* in the second longitudinal side wall 200*c* and the large opening 275 in the first longitudinal side wall 200*b* of the second container, and the large opening 375 in the first longitudinal side wall 300*b* of the third container, or passes above the second and third containers via the valve 170 to feed a line 171 connected to the top orifice 121 of the tube heat exchanger 120 of the first container, described below.

The various openings of the containers described above or below, namely the openings 170*a* and 175 of the first container, the openings 270*a* and 275 of the second container, and the openings 370*b*, 370*a*, and 370*c* of the third container, are rectangular openings with dimensions of approximately 50 cm×50 cm.

Advantageously, the electrical cables and the hydraulic lines may be constituted by portions of cable or portions of line including respective connection elements at their ends, more particularly plug connections, said connection elements at the ends of the cables and lines being fastened in the openings in said containers including connecting plugs for connecting said elements to the electrical cables, and connecting plugs for said connection elements at the ends of said lines. These plugs allow for rapid connection and disconnection of the various portions of cable or portions of line arranged inside the various containers.

The dissolution tank 110 of the first container 100 is in the form of a rectangular block and matches the dimensions of the first container 100 that is also rectangular. The first tank 100 comprises five walls with substantially the same dimensions as the five walls of the first container against which they are applied; however, a sixth wall of the first tank, constituting a front transverse side wall 110*b*, is set back from the front transverse side wall including the doors 160 of the first container in order to produce a compartment that can receive a pumping group 190. The pumping group 190 feeds the rectangular tank 110 with water from the cistern 30 with the pump 190*b*, and ensures that the aqueous phase is transferred from the first tank 110 to the portion of line 313 connected to the third tank 310 for preparing the emulsion with the pump 190*a*.

Access to the pumping group 190, for handling operations, is facilitated by it being in the immediate proximity of the doors 160 in the front transverse wall of the container 100, and also by the presence of an opening 175 formed in the rear longitudinal wall 100*b* of the first container facing the pumping group 190.

The dimensions of the rectangular tank, namely the length L1=4.40 m, makes it possible to optimize the quantity of aqueous phase that can be prepared in said first tank, given the size of the first container 100. In fact, since the proportions by weight used to prepare the reverse emulsion are 85% to 95%, preferably 90% to 94% of aqueous phase for 15% to 5%, preferably 10% to 6% of oily phase, the production capacity of the modular installation 1 is directly dependent on the quantity of aqueous phase produced during an emulsion preparation cycle.

The first tank 110 is closed off and is only accessible via the ceiling 110*a* where openings surrounded by vertical extension walls 135, 136 and 145 are formed, the upper ends of which pass through openings in the roof 103 of the first container 100 and extend above the roof 103 of the first container 100. Said vertical extension walls 145 form a cylinder of square or rectangular section substantially at the center of the ceiling 110*a* of the first tank, while the small extension walls 135 and 136 arranged either side of the large extension walls 145 are cylindrical in shape and circular in section, but may have a plate of square section at their base in order to close off the corresponding optional square opening in the ceiling 110*a* of the first tank.

Because of said extension walls 145, 135, and 136, in addition to the side openings 170, 175, and 370*a*, together with its door 160, said first container also includes openings in its roof 103 facing the openings of said first tank, namely two small openings corresponding to the small extension walls 135 and 136, and a large opening of square or rectangular section for passing the large cylindrical extension 145 of square or rectangular section.

Two small extension walls 135 and 136 respectively support vertical rods 130*c* and 131*c* extending inside the first tank 110 and each supporting two rotary blades 130*a*, 130*b* that can be driven in rotation about respective axes constituted by said rods 131*a*, 131*b*. Said rotary blades are driven in rotation by rotary drive motors 130*d* and 131*d* arranged above the roof 103 of the first container 100 to constitute stirrers 130 and 131 inside the first tank. Large extension walls 145 located between the two small extension walls 135, 136 open substantially at the center of the roof 110*a* of the first tank 110 and define a manhole via which granules of nitrates are fed from an external storage tank 10 to the first tank 110, driven by an external unloading screw 140.

During transport of the first container, the extension walls 135, 136 and 155 can be separated from the roof of the first tank and the corresponding openings on the roof 103 of the first container or the ceiling 110*a* of the first tank can be closed off with the aid of plates that also strengthen the structure of the container during transport. The elements supported by said small extension walls 135, 136, namely the rods forming the axes of rotation 130*c* and 131*c* and the motors 130*d* and 131*d* and the unloading screw 140 for the large extension wall 145, may also be dismantled and stowed for transport.

Advantageously, a deflector 141 arranged below the central opening defined by the large extension walls 145 at the top of the roof 110*a* of the first tank 110 can be used to deflect the granules of nitrate towards the two stirrers 130 and 131. Thus, the granules are readily entrained in rotation by the stirrers and dissolved in the solution present in the tank. In the absence of a deflector 141, the granules would fall into the middle of the tank, where they would not be acted upon sufficiently by the stirrers/mixers.

Figure 3:
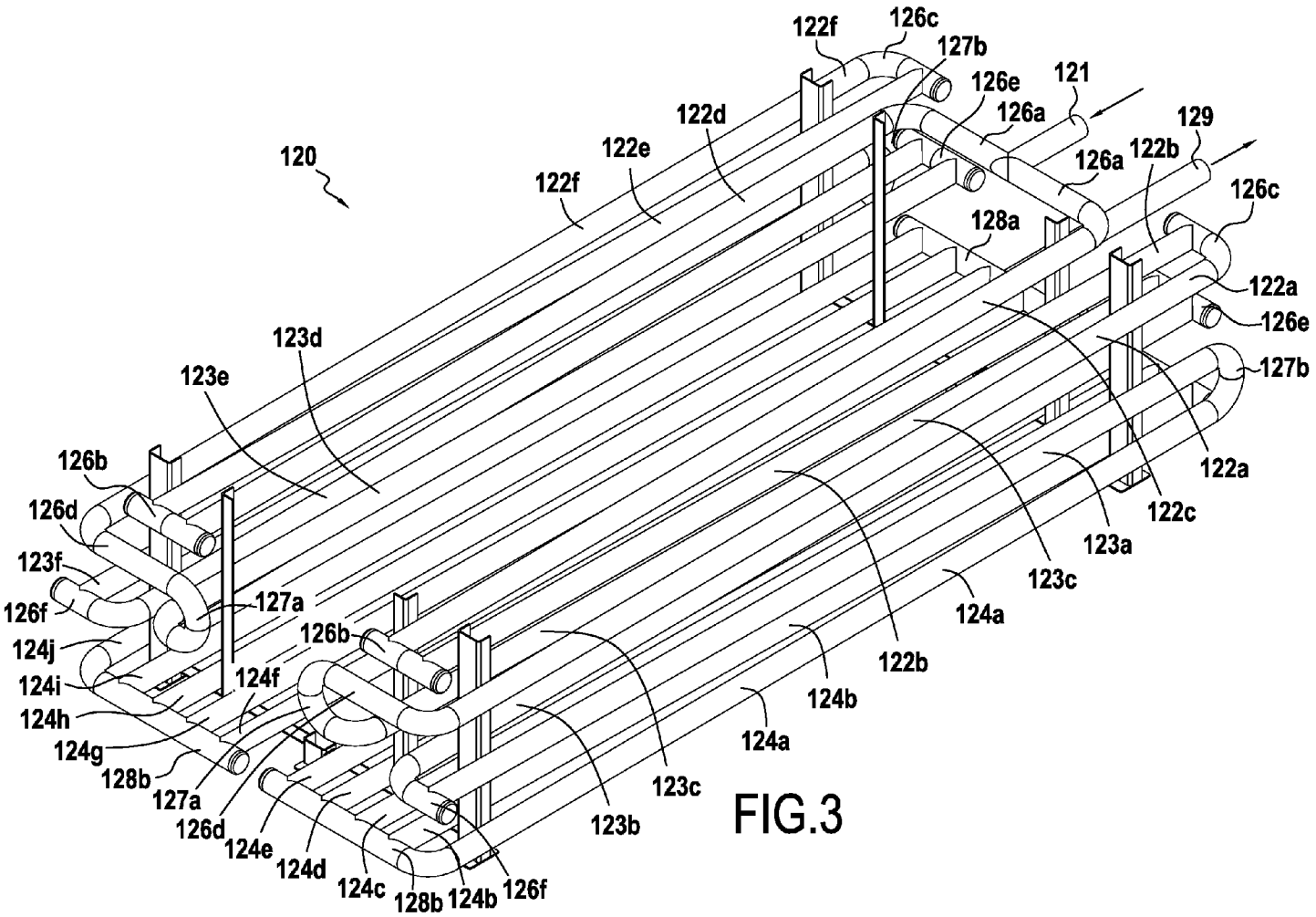
FIG. 3 shows a heat exchanger 120 for the aqueous phase preparation tank (said first tank 110)

In FIG. 3, the first tank 110 includes a heat exchanger 120 constituted by a set of three stages 122, 123, and 124 of parallel longitudinal lines of circular section, that are connected together so as to be continuous via horizontal line elements or transverse connectors 126*a* to 126*f* and 128*a*, 128*b* for the lines arranged in the same given stage. The term "parallel lines" of the same stage is used herein to mean that the lines of a given stage have their axes located in parallel planes, said lines nevertheless being slightly inclined relative to the horizontal, at an angle of less than 10° as is described below, so their axes are not strictly mutually parallel.

These lines of the heat exchanger 120 form a network of continuous lines in which the steam from the heater 410 flows. The ends of certain longitudinal lines at different stages of the heat exchanger are connected to those of an immediately higher or lower stage via vertical bend line elements extending in a vertical plane, also referred to below as vertical connectors 127*a*, 127*b*.

At the first and second stages 122 and 123, the longitudinal lines are arranged to provide an empty central space 120*a*. This empty central space 120*a* allows the rotary rods and the blades of the stirrers 130 and 131 to be passed through. In contrast, the third stage or bottom stage 124 covers the entire surface of the floor of the first tank substantially uniformly, the longitudinal lines therein being spaced apart from one another in the transverse direction by the same distance.

The small blades 130*a* and 131*a* of the stirrers 130 and 131 are located at a height between the second and third stages 122 and 123 of the heat exchanger 120 close to the lines of the third stage 124. In contrast, the large blades 130*b* and 131*b* of the stirrers 130 and 131 are located above the lines of the first stage 122 of the heat exchanger 120.

The structure of the heat exchanger 120 and the positioning of the blades or stirrers 130 and 131 are particularly adapted to dissolving nitrates in a rectangular tank.

The adjacent parallel longitudinal lines of a given stage are inclined at opposite angles and their ends of a given longitudinal side are connected together via horizontal transverse connectors. The end of at least one longitudinal line of each stage is connected to an end on the same side of at least one line of a bottom or higher stage via vertical bend connectors 127*a*, 127*b*. Having the various parallel longitudinal lines at an angle of inclination encourages both the flow of steam and also the recovery of condensates formed by the steam cooling in contact with the water or the aqueous phase at the bottom stage.

The heat exchanger 120 of FIG. 3 comprises 22 longitudinal lines with longitudinal axes that are arranged in mutually parallel planes. The 22 longitudinal lines are arranged symmetrically relative to a vertical middle plane of the heat exchanger.

The 22 longitudinal lines are arranged in three stages as follows:

- a first stage 122, or top stage, with six longitudinal lines 122*a* to 122*f*; and
- a second, intermediate, stage 123 with six longitudinal lines 123*a* to 123*f*; and
- a third, or bottom, stage 124 with ten longitudinal lines 124*a* to 124*j*.

At the third, or bottom, stage 124, the longitudinal lines are located close to the bottom wall 110*c* of the tank 110; said parallel longitudinal lines 124*a* to 124*j* are spaced apart by substantially the same distance in the transverse direction.

All of the ends of said longitudinal lines 124*a* to 124*j* of the third stage that are located on the same side are connected together via horizontal transverse line elements, termed transverse connectors 128*a* on one side and transverse connectors 128*b* on the other side. A first transverse connector 128*a* includes a central evacuation orifice 129 constituting a bottom outlet orifice of the heat exchanger 120 allowing heat transfer fluid to leave the heat exchanger before it is transferred and reheated in the heater 410 and then redirected to the top feed orifice 121 described below.

The top stage or first stage 122 of the heat exchanger comprises six longitudinal lines grouped as follows:

- a first group of three longitudinal lines 122*a*, 122*b*, 122*c* that are parallel and spaced apart by substantially the same distance in the transverse direction, being arranged on one side of an empty central space 120*a*; and a second group of three other longitudinal lines 122*d*, 122*e*, 122*f* that are parallel and spaced apart by substantially the same distance in the transverse direction, and located on the other side of the empty central space 120*a*, these three lines of the second group being symmetrically arranged relative to the three lines of the first group arranged on the other side of the central empty space 120*a*.

A top first transverse connector 126*a* including a central feed orifice 121 feeds the ends of a first side of the two longitudinal lines 122*c* and 122*d* defining said central space 120*a*.

The two lines 122*c* and 122*d* are slightly inclined at a downward angle towards their other longitudinal ends, along two top transverse connectors 126*b* connecting them to the longitudinal ends on the same side of the two lines 122*b* and 122*e* respectively. These lines 122*b* and 122*e* are in turn inclined at an opposite downward angle towards their other longitudinal ends going to transverse connectors 126*c* connecting them to the longitudinal ends on the same side of the two outer lines 122*a* and 122*f* respectively (and thus the furthest from the empty central space 120*a*). These outer lines 122*a* and 122*f* of the first stage 122 are again in turn inclined at an angle in the opposite direction, i.e. at a downward angle towards the first vertical bend connectors 127*a* at their other longitudinal ends (opposite those of the feed orifice 121 and outlet orifice 129).

The vertical connectors 127*a* formed by bend line elements connect said lines 122*a* and 122*f* to ends located on the same longitudinal side of the lines 123*c* and 123*d* of the second stage of lines 123.

The six mutually-parallel longitudinal lines 123*a* to 123*f* of the second stage 123 are also positioned in two groups of three lines arranged symmetrically relative to each side of the empty central space 120*a* above the third stage of lines, namely a first group of lines 123*a*, 123*b*, and 123*c*, and a second group of lines 123*d*, 123*e*, and 123*f*.

The two inner longitudinal lines 123*c* and 123*d* of the second stage defining the central space 120*a* are connected to two adjacent lines 123*b* and 123*e* respectively via first intermediate transverse connectors 126*e* at the longitudinal end opposite to that of the first vertical bend connectors 127*a*.

Because the first vertical bend connectors 127*a* provide a connection between the outer lines 122*a* and 122*f* and the inner lines of the second stage 123*c* and 123*d*, it should be understood that said vertical bend connectors 127*a* comprise a horizontal line section in the transverse direction 126*f*.

The two lines 123*c* and 123*d* are also inclined at an angle in the opposite direction relative to the lines 123*b* and 123*e* respectively so that they have a downward inclination towards their other longitudinal ends going to the second intermediate horizontal transverse connectors 126*d*, connecting them with the longitudinal ends on the same longitudinal side of the two outer lines of the second stage, 123*a* and 123*f* respectively.

The other longitudinal ends located on the same side as the feed orifices 121 and evacuation orifices 129 of the two outer lines of the second stage 123*a* and 123*f* respectively are connected to the longitudinal ends on the same side of the two outer lines of the third stage, 124*a* and 124*i*, via second vertical bend connectors 127*b*.

The two end lines 124*a* and 124*j* of the third stage 124 (bottom stage) are inclined downwardly from their ends connected to the second vertical connectors 127*b* to their ends connected to second bottom horizontal transverse connectors 128*b* arranged on the side opposite in the longitudinal direction to the side including the feed orifice 121 and the evacuation orifice 129.

The eight parallel longitudinal lines 124*b* to 124*i* of the third stage or bottom stage are substantially horizontal or at an angle inclined in the opposite direction relative to that of the two outer lines 124*a* and 124*j* from said second horizontal transverse connectors 128*b* in the direction of their other longitudinal ends all connected to the same first bottom transverse connector 128*a*, allowing heat transfer fluid (steam) to be evacuated to the central feed orifice 129.

To prepare the aqueous phase, in a first step, water from the cistern 30 is introduced into the first tank 110 until it covers the third stage or bottom stage 124 of the heat exchanger, i.e. approximately $1/8^{th}$ of the height of the tank, i.e. 2000 liters (L) to 5000 L, more particularly approximately 4000 L±500 L. The quantity of water introduced into the tank is measured using a flow meter connected to a central automated system. In a second step, the heat exchanger 120 is fed with steam and the mixers are activated. The water is then heated by contact with the third stage 124 of the heat exchanger associated with the action of the stirring mixers 130 and 131. When a temperature of at least 70° C., and preferably in the range 80° C.-85° C., is reached in the tank, a first portion of ammonium nitrate is introduced into the first tank 110 via the unloading screw 140 at a flow rate of 15 t/h. After mixing the solution with the stirrers and checking the temperature, another portion of nitrate is introduced into the first tank. This is continued until a quantity of approximately 20 t of nitrates has been added to the solution of approximately 4 t of water to obtain approximately 24 t of aqueous phase. Finally, the pH and water content are checked and corrected, if necessary by adding water or a weak acid to the tank. A dissolution additive, for example based on thiourea or sodium thiocyanate, is also added, i.e. approximately 100 kilograms (kg). When the first tank is full, above the first stage 122, it comprises proportions by weight of approximately 80%-82% of nitrate and 18%-20% and 0.2% to 0.6% of additives. The quantity of heat necessary to dissolve the nitrate fed by the heat exchanger 120 is approximately 6000 megajoules (MJ).

Figure 4A:
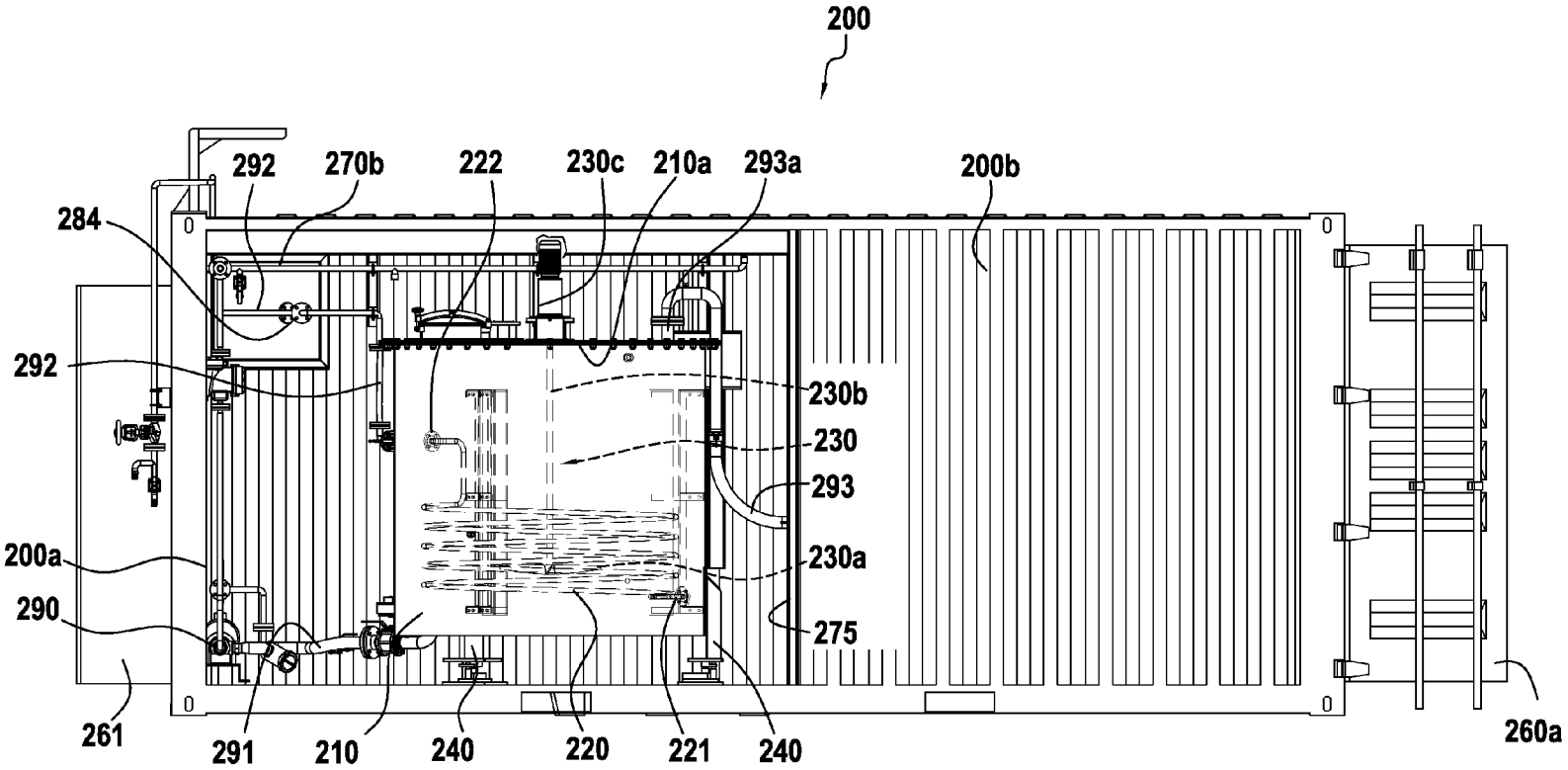
FIG. 4A is a view of the second container 200 at its first longitudinal wall 200*b* showing, through the open large opening 275, a second helical tube heat exchanger inside the second tank 210 for preparing the oily phase.
Figure 4B:
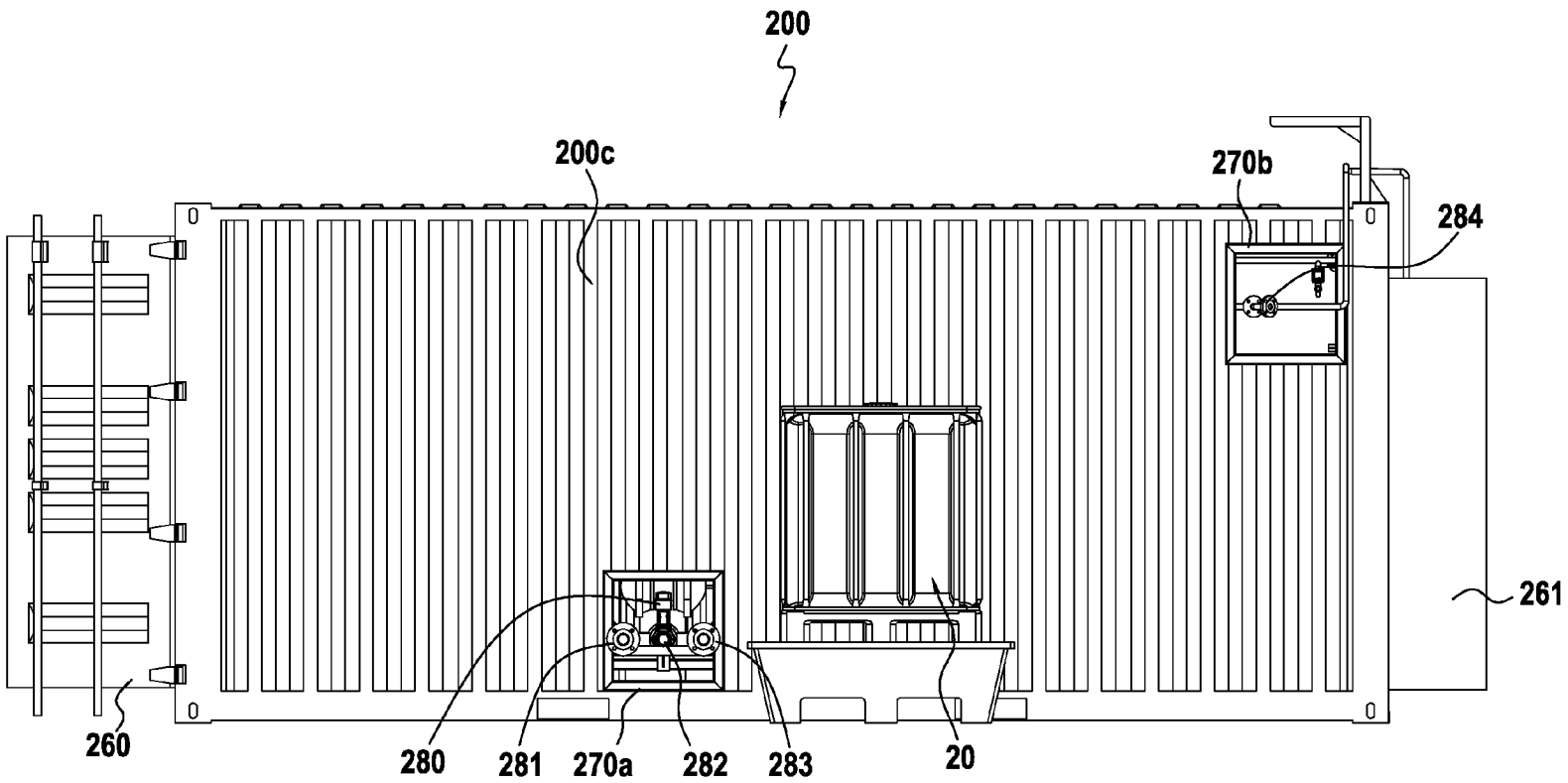
FIG. 4B is a view of the second longitudinal wall 200*c* of the second container 200 showing the external storage tanks 20 for components for use in preparing the oily phase outside the second container.

FIGS. 4A and 4B show the second container 200 serving in particular for preparing the oily phase, the second step of the process. The oily phase is obtained by homogeneously mixing fresh or recycled mineral oil such as paraffinic oils and fuel oil in proportions of 0 to 100%, preferably 50% to 80% of oil to which a non-ionic type surfactant is added in a proportion by weight of 10% to 30% of the total of the oily phase obtained. The surfactant is intended to facilitate mixing of the aqueous phase into the oily phase in the form of a reverse emulsion during the third step of the method in the third container.

The second container 200 includes a tank for preparing oily phase, termed the second tank 210, part of which is cylindrical of circular section, mounted on scales 240 with an internal volume V2 of approximately 3000 L; it also includes laboratory analysis furniture and equipment 250.

The scales 240 can be used to assess the weight of the second tank and its contents in order to monitor the quantities of oily phase produced or remaining, as is explained below. The laboratory 250 can be used to monitor the quality of the fluids obtained from the various steps of preparing the emulsion and the final product.

The second tank 210 is a cylindrical tank of circular section and within it there is an inner helical heat exchanger 220 arranged close to the inside face of the cylindrical wall of the heat exchanger. Inside the helical heat exchanger 220, the second tank 210 includes a mixer 230 with rotary blades supported by a vertical rod forming an axis of rotation 230*b* driven in rotation by a motor 230*c* arranged above the ceiling 210*a* of the second tank 210. Steam from the heater 410 is fed to the helical tube heat exchanger 220 via its upper opening 222 to heat the oily phase to a temperature of more than 40° C.-45° C., preferably 50° C.-60° C. The heat exchanger 220 and the mixer 230*a* can be used to obtain a homogeneous oily phase.

During preparation of the oily phase, the fuel oil, oil and the surfactant are introduced in succession into the second tank via the upper opening 293*a* at the level of the ceiling 210*a*. A system of pumps and valves regulated from a control panel 330 can be used to select the type of fluid introduced into the second tank 210 via the end 293*a* of a transfer line 293 having its other end connected to the pump 280, which is itself connected to the external tanks 20 for fuel oil, oil, and surfactants via lines connected to line connection valves 281, 182, and 283 respectively.

The quantity of oily phase introduced is measured during filling using scales 240 for assessing the weight of the second tank 210.

When the desired quantities of fuel and the oil have been introduced into the second tank, rotation (or actuation) of the stirrer 230 is commenced and steam is introduced into the heat exchanger 220 via the opening 222 at the top end of the helical coil of the heat exchanger 220. The surfactant is then introduced into the second tank 210. The quantity of steam introduced into the heat exchanger 220 is regulated so as to obtain the desired temperature of 40° C.-60° C., preferably 50° C.-55° C., in the second tank. The oily phase obtained is then kept at a constant temperature in the second tank 210 before being transferred to a line portion 312 connected to the third tank 310 for preparing the emulsion in the third container 300 at a mass flow rate regulated by a flow meter 311*a* in the third container, which is described below.

FIG. 4B represents a rear view that shows the various openings of the second container. The opening 270*a* of the second longitudinal wall 200*c* of the second container gives access to said valves 281, 282, 283 intended to be connected to the lines that are themselves connected to the external tanks 20 for storing fuel oil, oil, and surfactants. The top opening 270*b* of the wall 200*c* provides access to a valve 284 that optionally cooperates with a connecting hose 292 fed with steam via the heater 410. The second container 200 also includes a door 261 in its front transverse wall for facilitating access by an operator to the pumping group 190 of the container 100, and doors 260 on its rear transverse wall that can act as an emergency exit in the event of an incident.

Figure 5A:
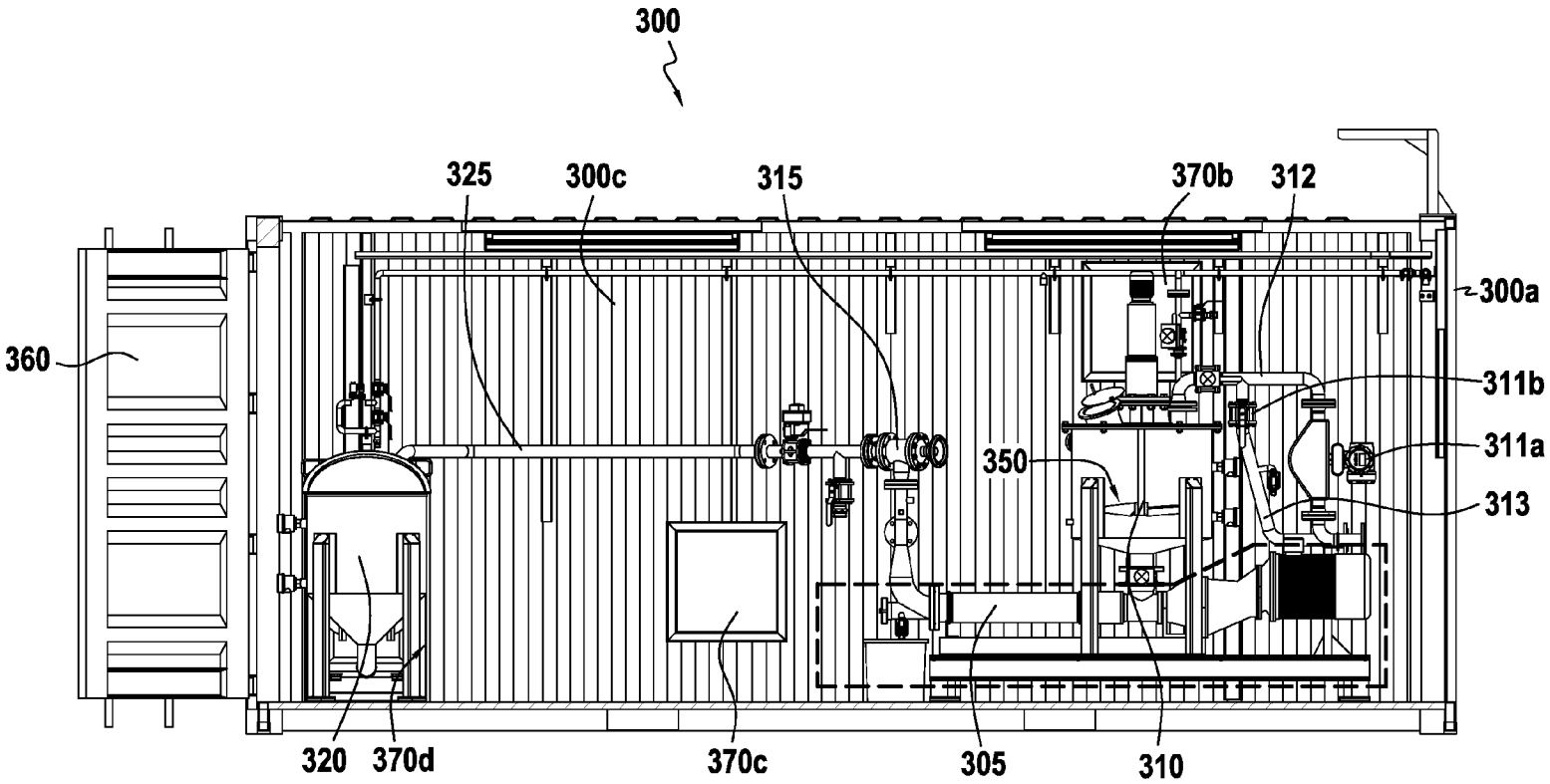
FIG. 5A is a longitudinal sectional view of the third container 300.
Figure 5B:
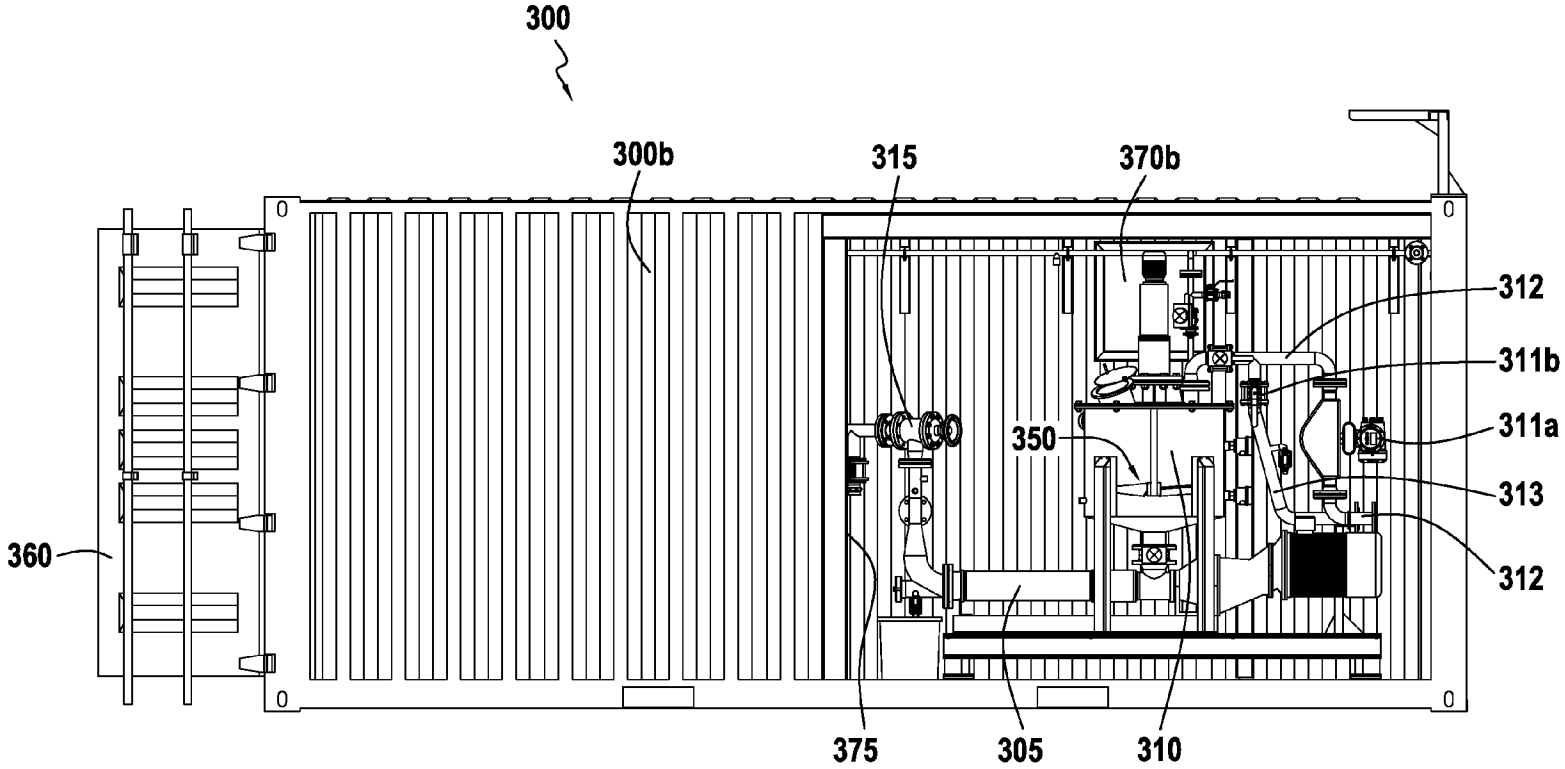
FIG. 5B is a view of the second container showing its first longitudinal wall 300*b* with its large opening 375 open, showing the interior of the third container with said third tank 310.
Figure 5C:
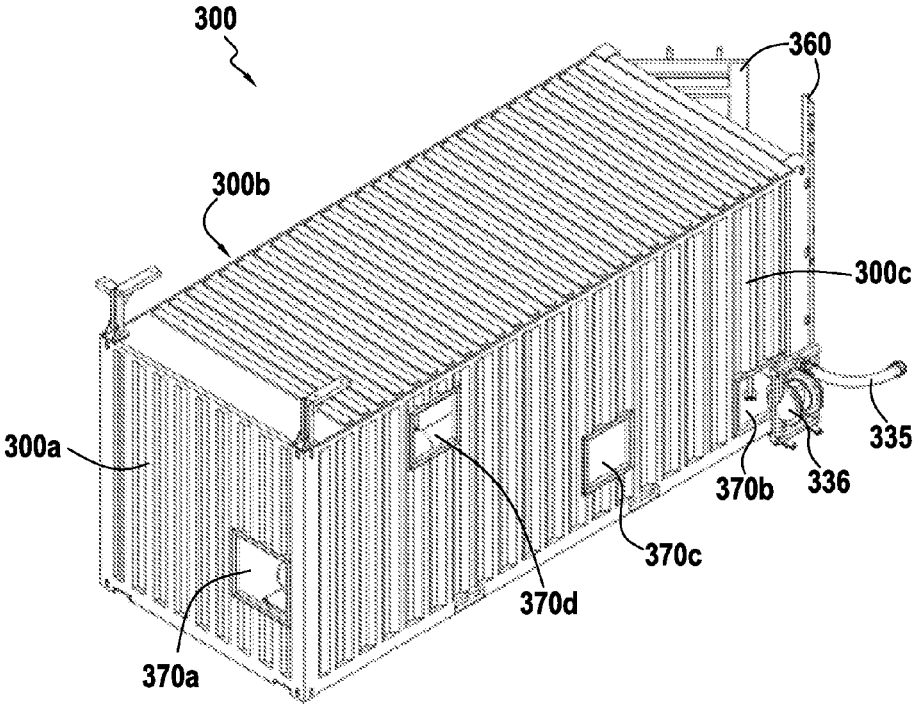
FIG. 5C is a perspective view of the third container 300.

FIGS. 5A, 5B and 5C show the third container 300 for preparing emulsion, the last step in the method of preparing emulsion by mixing the aqueous and oily phases.

The third container 300 contains:

- an essentially cylindrical third tank 310 for preparing emulsion, of circular section and of volume V3 that is less than 200 liters, equipped with stirrers 350; and
- a small buffer tank 320 intended to temporarily hold the emulsion produced in the third tank; and
- a pumping group 305 to route said emulsion towards the buffer tank or towards an evacuation line 335; and
- a transfer line 325 between the third tank 310 and the small tank 320 and/or an evacuation line 335, cooperating with a shear device 315 for increasing the viscosity of the emulsion; and
- a control panel 330 for controlling the various pumping means, stirrer means, and heater means, and the various valves and flow meters of the installation and an electrical cabinet 340 for controlling the electrical power supply for the entire installation.

The emulsion is produced in the third tank 310 by mixing the aqueous phase into the oily phase, the third tank 310 being equipped with stirrers 350. The oily phase produced in a preceding step is at a temperature of 50° C. to 55° C. in order to reduce the temperature difference with the aqueous phase, at 80° C.-85° C., and to facilitate mixing of the two phases.

The emulsion produced in the third tank 310 has low viscosity, and so its consistency makes it inappropriate for its subsequent use in preparing an explosive. Thus, after tapping, the emulsion is sent to a shear device 315 in order to increase the viscosity of the emulsion to a set value.

The emulsion is then temporarily stored in a buffer tank 320 before being subsequently routed to a storage silo or cistern (not shown). Temporary storage of the emulsion means that samples intended for quality control checks in the laboratory 250 can readily be taken. The operator can thus verify the composition and the physical properties of the emulsion before reaching the end of a production cycle. The operator can also visually check the nature of the emulsion produced.

The emulsion in the third tank 310 is prepared in two sub-steps. During a first, initiating, sub-step, the third tank 310 is filled with aqueous phase and oily phase in proportions by weight of 85%-95% of aqueous phase for 5%-15% of oily phase using mass flow meters 311*a* and 311*b*. Next, during a second sub-step, the third tank 310 is continuously fed with aqueous phase and oily phase, during which the pump 305 continuously removes an equivalent quantity of fluid emulsion and sends it to the shear means 315. The aqueous phase/oily phase percentage is maintained at all times using pumps equipped with mass flow meters. Thus, the mass flow rate for filling with aqueous phase is approximately 13 times higher than that of the oily phase. The two sub-steps are carried out in succession in a manner such that the third tank 310 is never empty, and so the flow rate for withdrawing the emulsion from the tank 310 is constant.

The tank 210 must contain an excess of oily phase because the mixing tank or third tank 310 is fed continuously, starting from the first tank 110 and the second tank 210 until the first tank 110 is exhausted.

Using a single second tank 210 with scales 240 means that firstly, the residual oily phase inside the second tank 210 can be weighed more precisely when the first tank 110 is exhausted, and secondly, that the final volume in the second tank 210 can be determined when the second tank 210 is replenished.

In the prior art, two aqueous phase preparation tanks are used that communicate with each other and that are equipped with graduations in order to know the quantity of oily phase not used and/or to measure the quantity of oily phase produced. Since the number of graduations is discrete, the precision obtained is mediocre. Using a tank with scales thus means that the use of a second tank can be dispensed with.

In FIG. 5C, the opening 370*a* in the front transverse wall 300*a* of the third container adjacent to the first container 100 allows lines for routing aqueous phase from the first tank 110 to the third, emulsion preparation, tank 310 to pass through, the lines comprising a line 313 cooperating with an adjustable flow meter 311*b* inside the third container.

Concerning the openings 170 of the first tank and 370*a* of the third tank, a connecting element is advantageously provided at the end of the line portion 313 that allows a rapid connection to be made with a line portion extending inside the first container connected to the pumping group 190 and to the first tank.

The other openings 370*b*, 370*c* and 370*d* of the third container are located on the rear longitudinal wall 300*c* that is not adjacent to the second container.

The opening 370*d* is located above the third tank 310 for preparing the emulsion, meaning that it can communicate with an optional device for extracting vapor from the third tank 310 for preparing the emulsion via hydraulic lines.

An opening 370*c* located between the third tank 310 for preparing the emulsion and the small buffer tank 320 allows for communication with an optional module for cooling the emulsion 610 in an optional sixth container 600. More precisely, these hydraulic lines allow the cooling tower 615 and plate heat exchanger 620 to be connected to the line 325 connecting the shear device to the buffer tank via a corresponding opening, not shown.

The opening 370*b* located behind the buffer tank 320 allows the emulsion to be routed to a silo or a storage cistern 50 via an evacuation line 335 cooperating with a valve 336.

Regarding the supply of steam from the heater 410, a line 420 can feed the first tank of the first container, while a steam line 430 can be used to feed a feed line 292 of the end 222 of the helical coil of the heat exchanger 220 via a connection 284 at the orifice 270*b* in the free longitudinal wall 200*c* of the second container.

Thus, it is possible to produce 25 t to 50 t of emulsion in 8 h during continuous daily production.

In the embodiment described here, the heater 410 feeds steam to the modular installation. In other embodiments, the heater could feed the installation with hot fluid, in particular with hot water.

In the embodiment described here, ammonium nitrate is used to prepare the aqueous phase. Sodium or calcium nitrates could also be used.

In similar manner, the fuel oil and the oil used to prepare the oily phase may be replaced by other vegetable and/or mineral oils.

The invention claimed is:

1. A modular installation for carrying out a method of manufacturing an explosive emulsion precursor constituted by a water-in-oil reverse emulsion, the method comprising:

a) a step of preparing an aqueous phase by dissolving nitrates in water and heating;

b) a step of preparing an oily phase by mixing components comprising at least one vegetable and/or mineral fat and a surfactant, and heating; and c) a step of preparing said emulsion by mixing said aqueous phase into said oily phase, the modular installation comprising at least:

a first container for preparing the aqueous phase, said first container including a first dissolution tank provided with first heater means and first stirrer means capable of heating and stirring the aqueous phase contained in the first container, wherein the first container includes a first rectangular tank with at least five walls arranged against and parallel to the respective at least five walls of said first container, said first heater means for said first tank comprising a first tube heat exchanger, said first tube heat exchanger being constituted by a network of continuous heat transfer fluid cylindrical transfer lines arranged longitudinally and transversely at different heights, which are capable of heating the liquid contained in said first rectangular tank by distributing the heat from the heat transfer fluid circulating in said network of lines throughout the volume of said first tank, wherein said cylindrical longitudinal lines are arranged substantially at the same height, and connected together at their ends on the same side by line elements forming horizontal transverse connectors, one end of at least one longitudinal line arranged at a given height being connected to the end of a longitudinal line arranged at a lower or higher height via at least one vertical bend line element.

2. The modular installation according to claim 1, wherein said first heat exchanger of the first tank of rectangular shape comprises a network of cylindrical longitudinal lines with a larger number of lines in the lower portion of the first tank.

3. The modular installation according to claim 1, wherein said first container containing first circulation means for circulating, by pumping, at least said aqueous phase and water for feeding said first container from a first external tank, located between a sixth transverse side wall of said first tank and a front transverse side wall of said first container.

4. The modular installation according to claim 1, wherein the lines of the upper levels are arranged at small downwardly inclined angles, at an angle of less than 10° relative to the horizontal at the height of an upper transverse connector to a lower evacuation orifice at the height of a first bottom transverse connector.

5. The modular installation according to claim 3, wherein the first heat exchanger in the first tank comprises:

a bottom stage of said longitudinal lines covering the floor of said first rectangular tank, said lines of the bottom stage being regularly spaced in the transverse direction of the first tank and extending substantially horizontally in the longitudinal direction from at least one second bottom transverse connector to said first bottom transverse connector; and at least one higher stage of said longitudinal lines, in a smaller number than the lines of the bottom stage, the lines of the higher stage being positioned either side of a central space with a dimension in the transverse direction of the tank that is larger than the space between two said adjacent lines positioned on the same side of said central space, said central space containing a portion of said first means for stirring the aqueous phase; and the adjacent longitudinal lines of a given stage being inclined, and their ends on a given longitudinal side are connected together via horizontal transverse connectors.

6. The modular installation according to claim 5, wherein a portion of said first stirrer means for stirring the aqueous phase is positioned at a height between said higher stage and said bottom stage, and another portion of said first stirrer means is positioned above said higher stage.

7. The modular installation according to claim 6, wherein said first tank is closed off and is accessible via closable openings in its ceiling and in the roof of the first container.

8. The modular installation according to claim 7, wherein the roof of the first container and the ceiling of said first tank are provided with first openings facing each other and surrounded by first vertical extension walls, which are preferably removable, extending from the ceiling of the first tank to above the roof of the first container and said first extension walls supporting or being capable of supporting elements for routing nitrate into the first tank through said first openings, the nitrate being distributed inside the first tank in the direction of the first stirrer means with the aid of at least one deflector arranged below the first opening in the ceiling of the first tank, said first openings in the ceiling of the first tank and in the roof of the first container being closable, being capable of being closed off during transport of said first container and said first tank.

9. The modular installation according to claim 7, wherein the roof of the first container and the ceiling of the first tank include second openings facing each other and surrounded by second vertical extension walls that are preferably removable, said second extension walls extending from the ceiling of the first tank to above the roof of the first container, said second extension walls supporting first stirrer means comprising at least one vertical rod extending inside the first tank on which rotary stirring blades are mounted that can be driven in rotation about a vertical axis with the aid of a motor, said motor being fixed in a non-permanent manner on the roof of the first container, said second openings being capable of being closed and thus capable of being closed off during transport.

10. The modular installation according to claim 1, wherein the first tank includes a heat exchanger constituted by a set of three stages of parallel longitudinal lines of circular section, that are connected together so as to be continuous via horizontal line elements or transverse connectors for the lines arranged in the same given stage, the ends of certain longitudinal lines at different stages of the heat exchanger are connected to those of an immediately upper or bottom stage via vertical angled line elements extending in a vertical plane, as vertical connectors, the longitudinal lines at the first and second stages being arranged to provide a central empty space allowing rotary rods and blades of stirrers to be passed through, the third stage or bottom stage covering the entire surface of the floor of the first tank substantially uniformly, the longitudinal lines therein being spaced apart from one another in the transverse direction by the same distance, the smaller blades of the stirrers being located at a height between the second and third stages of the heat exchanger close to the lines of the third stage, the larger blades of the stirrers being located above the lines of the first stage of the heat exchanger.

11. The modular installation according to claim 1, comprising:

a second container containing a second tank containing second heater means and second stirrer means for preparing the oily phase, and a third container containing a third tank containing third stirrer means for preparing the emulsion.

12. The modular installation according to claim 11, comprising:

at least one of said second and/or third containers containing second circulation means for circulating, by pumping, said oily phase from the second tank to the third tank and for circulating the components of the oily phase from external tanks for storing said components to said second tank, and third circulation means for circulating, by pumping, to evacuate said emulsion from said third tank to an emulsion storage tank; and a fourth container containing heat transfer fluid feed means and a fifth container containing electrical energy supply means for supplying electrical energy to at least said circulation means for circulating fluid by pumping, and to said stirrer means;

said first, second, and/or third containers being juxtaposed at least over a portion of one of their side walls, such that at least a portion of a side wall of said first container is juxtaposed with at least a portion of a side wall of said third container, and at least a portion of a side wall of the second container being juxtaposed with at least a portion of another side wall of the third container, such that said third container is interposed between said first container and said second container; and said first, second, and/or third containers include openings in their walls; wherein lines for transferring fluid between said containers and/or electrical cables pass through said openings, or are connected to said openings;

said openings being capable of being closed off, in particular, during transport of the containers.

13. The modular installation according to claim 11, wherein:

said first, second, and third containers, which are of rectangular shape and have standard dimensions, juxtaposed as follows:

at least a front portion of a longitudinal side wall of the first container, close to a front transverse side wall equipped with door(s) of the first container, is juxtaposed with at least a portion of a front transverse side wall of said third container, said front portion of the longitudinal side wall of the first container being provided with a small first opening leading to the portion of the first container including first circulation means for circulating, by pumping, said first small opening being juxtaposed and facing a second small opening in said side wall of the third container, said first and second small openings allowing the passage and/or connection of lines for transferring aqueous phase from said first tank to said third tank; and a first longitudinal side wall of the second container provided with a first large opening being juxtaposed with a first longitudinal side wall of the third container provided with a second large opening facing said first large opening, said first and second large openings allowing the passage of personnel and the passage of said fluid transfer lines between said second and third containers, a front transverse side wall of the second container including a door aligned with said front transverse wall of the third container; and a second longitudinal side wall of the second container being provided with at least one third small opening allowing the passage and/or connection of transfer lines for components of the oily phase from external storage tanks for storing the components of the oily phase to said second tank, and allowing passage and/or connection of the heat transfer fluid transfer line from said heat transfer fluid feed means to said second heater means of said second tank; and a second longitudinal side wall of the third container being provided with at least one opening allowing the passage and/or connection of lines for evacuating said emulsion from said third tank to a tank for storing the emulsion.

14. The modular installation according to claim 11, wherein:

said first container includes a portion of line for transferring fluid from said first tank to said third tank, as well as a portion of line for transferring heat transfer fluid between said heat transfer fluid feed means and said first heater means inside said first tank, and a portion of line for feeding water to said first tank; and said second container contains a portion of line for transferring oily phase between said second tank and said third tank, as well as a portion of line for transferring heat transfer fluid between said heat transfer fluid feed means and said second heater means inside said second tank, and portions of lines for feeding oil and surfactants, respectively, to said second tank; and said third container contains a portion of line for transferring aqueous phase from said first tank to said third tank and a portion of line for transferring oily phase from said second tank to said third tank, and a portion of line for evacuating said emulsion from said third tank to an external storage tank and/or a buffer tank for storing said emulsion.

15. A method of preparing an explosive precursor constituted by said emulsion using a modular installation according to claim 11, said method comprising:

a) a step of preparing said aqueous phase by dissolving nitrates in water and heating in said first tank;

b) a step of preparing said oily phase and heating in said second tank; and c) a step of preparing the emulsion by mixing the aqueous phase into the oily phase inside said third tank, without heating.

16. The method of preparing an explosive precursor according to claim 15, comprising the following steps:

continuously filling the third tank with said aqueous phase and oily phase; and stabilizing the emulsion, and increasing the viscosity of the emulsion evacuated from said third tank in a controlled manner with the aid of a shear device.

17. The method of preparing an explosive precursor according to claim 16, wherein the step of mixing the aqueous phase into the oily phase comprises two sub-steps:

a first sub-step in which an initial quantity of emulsion is prepared by mixing the aqueous phase and the oily phase initially introduced consecutively into the third emulsion preparation tank; and a second sub-step in which the emulsion is prepared by mixing the aqueous phase and the oily phase introduced continuously into said third tank, and wherein the ratio between the pumping flow rates of said aqueous phase and said oily phase, controlled by flow meters, corresponds to the desired proportions for the aqueous phase and the oily phase, in proportions by weight of 85-95% of aqueous phase for 5-15% of oily phase;

the two said sub-steps following each other, such that said third tank is never empty, the flow rate for evacuation of the emulsion from said third tank by tapping being constant.

18. The method of preparing an explosive precursor according to claim 17, wherein:

in step c), said third tank is continuously fed with aqueous phase from the first tank and with oily phase from the second tank until the first tank is empty; and in step b), said oily phase is prepared in a single second tank equipped with scales, the oily phase being maintained in excess in the second tank, and said scales being used firstly to weigh the residue of the oily phase inside the second tank when the first tank is empty, and secondly to measure the final volume of the second tank after filling the second tank.

19. A modular installation for carrying out a method of manufacturing an explosive emulsion precursor constituted by a water-in-oil reverse emulsion, the method comprising:

a) a step of preparing an aqueous phase by dissolving nitrates in water and heating;

b) a step of preparing an oily phase by mixing components comprising at least one vegetable and/or mineral fat and a surfactant, and heating; and c) a step of preparing said emulsion by mixing said aqueous phase into said oily phase, wherein the modular installation comprises containers arranged as follows:

a first container for preparing the aqueous phase, said first container including a dissolution first tank provided with first heater means and first stirrer means for heating and stirring the aqueous phase contained in the first container, and said first container containing first circulation means for circulating, by pumping, at least said aqueous phase and water for feeding said first container from a first external tank; and a second container containing a second tank containing second heater means and second stirrer means for preparing the oily phase, and a third container containing a third tank containing third stirrer means for preparing the emulsion; and at least one of said second and/or third containers containing second circulation means for circulating, by pumping, said oily phase from the second tank to the third tank and for circulating the components of the oily phase from external tanks for storing said components to said second tank, and third circulation means for circulating, by pumping, to evacuate said emulsion from said third tank to an emulsion storage tank; and at least one fourth and/or fifth container including heat transfer fluid feed means for feeding heat transfer fluid to said heater means and electrical energy supply means for supplying electrical energy to at least said circulation means for circulating fluid by pumping and to said stirrer means;

said first, second, and/or third containers being juxtaposed at least over a portion of one of their side walls, such that at least a portion of a side wall of said first container is juxtaposed with at least a portion of a side wall of said third container, and at least a portion of a side wall of the second container is juxtaposed with at least a portion of another side wall of the third container, such that said third container is interposed between said first container and said second container; and said first, second, and/or third containers include, in their walls, openings via which there pass and/or are connected lines for transferring fluid between said containers and/or electrical cables;

said openings being capable of being closed off, in particular of being closed off during transport of the containers.

20. The modular installation according to claim 19, wherein it comprises:

said first, second, and third containers, which are of rectangular shape and have standard dimensions, juxtaposed as follows:

at least a front portion of a longitudinal side wall of the first container close to a front transverse side wall equipped with door(s) of the first container is juxtaposed with at least a portion of a front transverse side wall of said third container, said front portion of the longitudinal side wall of the first container being provided with a small first opening leading to the portion of the first container including first circulation means for circulating by pumping, said first small opening being juxtaposed and facing a second small opening in said side wall of the third container, said first and second small openings allowing the passage and/or connection of lines for transferring aqueous phase from said first tank to said third tank; and a first longitudinal side wall of the second container provided with a first large opening being juxtaposed with a first longitudinal side wall of the third container provided with a second large opening facing said first large opening, said first and second large openings allowing the passage of personnel and the passage of said fluid transfer lines between said second and third containers, a front transverse side wall of the second container including a door aligned with said front transverse wall of the third container; and a second longitudinal side wall of the second container being provided with at least one third small opening allowing the passage and/or connection of transfer lines for components of the oily phase from external storage tanks for storing the components of the oily phase to said second tank, and allowing passage and/or connection of the heat transfer fluid transfer line from said heat transfer fluid feed means to said second heater means of said second tank; and a second longitudinal side wall of the third container being provided with at least one opening allowing the passage and/or connection of lines for evacuating said emulsion from said third tank to a tank for storing the emulsion.

21. The modular installation according to claim 19, wherein:

said first container includes a portion of line for transferring fluid from said first tank to said third tank, as well as a portion of line for transferring heat transfer fluid between said heat transfer fluid feed means and said first heater means inside said first tank, and a portion of line for feeding water to said first tank; and said second container contains a portion of line for transferring oily phase between said second tank and said third tank, as well as a portion of line for transferring heat transfer fluid between said heat transfer fluid feed means and said second heater means inside said second tank, and portions of lines for feeding oil and surfactants respectively to said second tank; and said third container contains a portion of line for transferring aqueous phase from said first tank to said third tank and a portion of line for transferring oily phase from said second tank to said third tank, and a portion of line for evacuating said emulsion from said third tank to an external storage tank and/or a buffer tank for storing said emulsion.

22. The modular installation according to claim 19, wherein the first container includes a first rectangular tank with at least five walls arranged against and parallel to the respective at least five walls of said first container, said first heater means for said first tank comprising a first tube heat exchanger, said first tube heat exchanger being constituted by a network of continuous heat transfer fluid transfer lines arranged longitudinally and transversely at different heights, which are capable of heating the liquid contained in said first rectangular tank by distributing the heat from the heat transfer fluid circulating in said network of lines throughout the volume of said first tank, with a larger number of lines in the lower portion of the first tank, and said first container further containing said first circulation means for circulating fluid by pumping located between a sixth transverse side wall of said first tank and a front transverse side wall of said first container.

23. The modular installation according to claim 22, wherein said first heat exchanger of the first rectangular tank comprises a network of cylindrical longitudinal lines arranged continuously at different heights, the longitudinal lines arranged substantially at the same height being connected together at their ends on the same side by line elements forming horizontal transverse connectors, and one end of at least one longitudinal line arranged at a given height being connected to the end of a longitudinal line arranged at a lower or higher height via at least one vertical bend line element, the lines of the upper levels being arranged at small downwardly inclined angles, at an angle of less than 10° relative to the horizontal in the direction for circulating the heat transfer fluid from a top feed orifice at the height of an upper transverse connector to a lower evacuation orifice at the height of a first bottom transverse connector.

24. The modular installation according to claim 23, wherein the first heat exchanger in the first tank comprises:

a bottom stage of said longitudinal lines covering the floor of said first rectangular tank, said lines of the bottom stage being regularly spaced in the transverse direction of the first tank and extending substantially horizontally in the longitudinal direction from at least one second bottom transverse connector to said first bottom transverse connector; and at least one higher stage of said longitudinal lines, in a smaller number than the lines of the bottom stage, the lines of the higher stage being positioned either side of a central space with a dimension in the transverse direction of the tank that is larger than the space between two said adjacent lines positioned on the same side of said central space, said central space containing a portion of said first means for stirring the aqueous phase.

25. The modular installation according to claim 24, wherein portion of said first stirrer means for stirring the aqueous phase is positioned at a height between said higher stage and said bottom stage, and another portion of said first stirrer means is positioned above said higher stage.

26. The modular installation according to claim 22, wherein the roof of the first container and the ceiling of said first tank are provided with first openings facing each other and surrounded by first vertical extension walls, which are preferably removable, extending from the ceiling of the first tank to above the roof of the first container and said first extension walls supporting or being capable of supporting elements for routing nitrate into the first tank through said first openings, the nitrate preferably being routed into the first tank with the aid of an unloading screw, the nitrate being distributed inside the first tank in the direction of the first stirrer means with the aid of at least one deflector arranged below the first opening in the ceiling of the first tank, said first openings in the ceiling of the first tank and in the roof of the first container being closable, being capable of being closed off during transport of said first container and said first tank.

27. The modular installation according to claim 22, wherein the roof of the first container and the ceiling of the first tank include second openings facing each other and surrounded by second vertical extension walls that are preferably removable, said second extension walls extending from the ceiling of the first tank to above the roof of the first container, said second extension walls supporting first stirrer means comprising at least one vertical rod extending inside the first tank on which rotary stirring blades are mounted that can be driven in rotation about a vertical axis with the aid of a motor, said motor being fixed in a non-permanent manner on the roof of the first container, said second openings being capable of being closed and thus being capable of being closed off during transport.

28. The modular installation according to claim 19, wherein the second container for preparing the oily phase includes a single second tank supported by scales and including, inside the second tank, second heater means comprising a second heat exchanger with a helical shape.

29. The modular installation according to claim 19, wherein the third container for preparing the emulsion includes a said third tank for mixing, a shear device for increasing the viscosity of the emulsion evacuated from said third tank in a controlled manner in the direction of a buffer fourth tank intended to temporarily hold the emulsion prepared in said third tank for analysis before evacuation to an external tank for storing the emulsion outside the third container, and the second container and/or the third container include furniture and equipment for laboratory analysis, a control panel for the various said circulation means for circulating by pumping, heater means, and stirrer means.

30. The method of preparing an explosive precursor constituted by a said emulsion by using a modular installation according to claim 15, the method comprising:

a) a step of preparing a said aqueous phase by dissolving nitrates in water and heating in said first tank;

b) a step of preparing a said oily phase and heating in said second tank; and c) a step of preparing the emulsion by mixing the aqueous phase into the oily phase inside said third tank, without heating.

31. The method of preparing an explosive precursor according to claim 30, wherein the following steps are carried out, comprising:

a step of continuously filling the third tank with said aqueous phase and said oily phase; and a step of stabilizing the emulsion and increasing the viscosity of the emulsion evacuated from said third tank in a controlled manner with the aid of a shear device.

32. The method of preparing an explosive precursor according to claim 30, wherein the step of mixing the aqueous phase into the oily phase comprises two sub-steps:

a first sub-step in which an initial quantity of emulsion is prepared by mixing the aqueous phase and the oily phase initially introduced consecutively into the third emulsion preparation tank; and a second sub-step in which the emulsion is prepared by mixing the aqueous phase and the oily phase introduced continuously into said third tank and wherein the ratio between the pumping flow rates of said aqueous phase and said oily phase, controlled by flow meters, corresponds to the desired proportions for the aqueous phase and the oily phase, in proportions by weight of 85-95% of aqueous phase for 5-15% of oily phase;

the two said sub-steps following each other, such that said third tank is never empty, the flow rate for evacuation of the emulsion from said third tank by tapping being constant.

33. The method of preparing an explosive precursor according to claim 32, wherein:

in step c), said third tank is continuously fed with aqueous phase from the first tank and with oily phase from the second tank until the first tank is empty; and in step b), said oily phase is prepared in a single second tank equipped with scales, the oily phase being maintained in excess in the second tank, and said scales being used firstly to weigh the residue of the oily phase inside the second tank when the first tank is empty, and secondly to measure the final volume of the second tank after filling the second tank.

* * * * *